US006609506B2

(12) United States Patent
Matsuura et al.

(10) Patent No.: US 6,609,506 B2
(45) Date of Patent: Aug. 26, 2003

(54) EXHAUST GAS RECIRCULATION SYSTEM

(75) Inventors: Hiromi Matsuura, Wako (JP); Kazuhiro Takashiba, Wako (JP); Takahiro Shinkai, Wako (JP); Takuji Yamamoto, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 69 days.

(21) Appl. No.: 09/892,756

(22) Filed: Jun. 28, 2001

(65) Prior Publication Data

US 2002/0000222 A1 Jan. 3, 2002

(30) Foreign Application Priority Data

Jul. 3, 2000 (JP) ..... 2000-201342
Aug. 7, 2000 (JP) ..... 2000-238976

(51) Int. Cl.[7] ..... F02M 25/07
(52) U.S. Cl. ..... 123/568.11
(58) Field of Search ..... 123/568.11, 568.12

(56) References Cited

U.S. PATENT DOCUMENTS 4,114,370 A 9/1978 Woods
4,147,031 A 4/1979 Tanuma et al.
4,356,806 A 11/1982 Freesh
4,558,681 A * 12/1985 Mookerjee ..... 123/568.11
5,979,421 A 11/1999 Yamashita et al.
2001/0008616 A1 * 7/2001 Haga et al. ..... 422/234

FOREIGN PATENT DOCUMENTS

WO 00 31403 A 6/2000
WO 00 34630 A 6/2000

* cited by examiner

*Primary Examiner*—Henry C. Yuen
*Assistant Examiner*—Arnold Castro
(74) *Attorney, Agent, or Firm*—Armstrong, Westerman & Hattori, LLP.

(57) ABSTRACT

A recirculation exhaust gas extracted from the exhaust passage of an internal combustion engine and flowing through a recirculation passage. A recirculation control valve (6) controls the flow of the recirculation exhaust gas in the recirculation passage. A recirculation pipe (7) forming the recirculation passage has a hot or contact section (7*c*, 7*e*) extending near and along an exhaust manifold (1). The recirculation pipe (7) and the exhaust manifold (1) are covered with a heat-insulation cover (10). The drop of the temperature of the recirculation exhaust gas flowing through the recirculation passage is suppressed and the deposition of deposits including carbon in the recirculation control valve (6) is suppressed.

4 Claims, 15 Drawing Sheets

EXHAUST GAS RECIRCULATION SYSTEM

BACKGROUND OF THE INVENTION

1. Field of the Invention

The present invention relates to an exhaust gas recirculation system (EGR system) incorporated into an internal combustion engine to recirculates part of the exhaust gas discharged from the internal combustion engine at a controlled flow controlled by a recirculation control valve to an intake passage and, more specifically, to the construction of a flow passage connecting an exhaust passage and the recirculation control valve.

2. Description of the Related Art

A conventional internal combustion engine is provided with an exhaust gas recirculation system for recirculating part of the exhaust gas to an intake passage to suppress the generation of $NO_x$ by lowering maximum combustion temperature and to improve fuel consumption by reducing pumping loss. In the exhaust gas recirculation system, a recirculation control valve for controlling the flow of the recirculation exhaust gas is attached to the cylinder head of the internal combustion engine, and a recirculation exhaust gas inlet through which part of the exhaust gas flowing through an exhaust passage is extracted is formed in an exhaust manifold or an exhaust pipe connected to the lower end of the exhaust manifold.

When the recirculation exhaust gas inlet is formed in a lower part of the exhaust manifold, the exhaust pipe or a part of the exhaust pipe below a part of the exhaust pipe where a catalytic converter is placed, the recirculation exhaust gas inlet is at a relatively lower position on the exhaust passage with respect to the flowing direction of the exhaust gas. Therefore, a relatively long recirculation passage is needed to connect the exhaust gas passage and the recirculation control valve attached to the cylinder head. Thus the recirculation exhaust gas taken out of the exhaust passage dissipates heat into the atmosphere and is subject to cooling while the same flows through the recirculation passage to the recirculation control valve. Consequently, carbon and hydrocarbons (HC) contained in the recirculation exhaust gas are not oxidized and deposit deposits including carbon on the valve element of the recirculation control valve and in the gas passage of the recirculation control valve. The deposits in the passages obstruct the flow of the recirculation exhaust gas and make the recirculation control valve unable to function properly for flow control.

Heat dissipation while the recirculation exhaust gas is flowing through the recirculation passage may be reduced by reducing the length of the recirculation passage. However, the length of the recirculation passage cannot be reduced below a minimum necessary length dependent on the positional relation between the recirculation gas outlet and the recirculation control valve. Even if the recirculation passage is formed in the shortest possible length, the recirculation exhaust gas is still apt to dissipate heat into the atmosphere and to be cooled. Thus the reduction of the length of the recirculation passage cannot be an effective means for suppressing the deposition of deposits on the recirculation passage.

The present invention has been made in view of such circumstances and it is therefore an object of the present invention to provide an exhaust gas recirculation system of simple construction capable of suppressing the drop of the temperature of a recirculation exhaust gas flowing through a recirculation passage between an exhaust passage and a recirculation control valve and of suppressing the deposition of deposits including carbon on the components of the recirculation control valve.

Another object of the present invention is to provide an exhaust gas recirculation system for a multicylinder internal combustion engine having a plurality of cylinders, capable of preventing the extraction of part of an exhaust gas from an exhaust passage as a recirculation exhaust gas from making the ratios of effect of the cylinders on a measured value measured by an exhaust gas analyzer placed in the exhaust passage to acquire data for estimating an air-fuel ratio differ from each other.

SUMMARY OF THE INVENTION

According to a first aspect of the present invention, an exhaust gas recirculation system includes: a recirculation passage having one end connected to an exhaust passage included in an internal combustion engine and the other end connected to an intake passage included in the internal combustion engine to extract part of an exhaust gas as a recirculation exhaust gas from the exhaust passage and to recirculate the same to the intake passage; and a recirculation control valve placed in the recirculation passage to control the flow of the recirculation exhaust gas into the intake passage; wherein a recirculation pipe forming a part of the recirculation passage has a section extended close to and along an exhaust pipe forming a part of the exhaust passage.

The section, extended close to and along the exhaust pipe, of the recirculation pipe for carrying the recirculation exhaust gas extracted from the exhaust passage to the recirculation control valve is included in an environment heated at a high temperature by the heat radiated by the exhaust pipe heated at a high temperature by the exhaust gas. Therefore, heat dissipation from the recirculation pipe into the atmosphere is small even if the recirculation pipe is long and the drop of the temperature of the recirculation exhaust gas flowing through the recirculation pipe is suppressed. Consequently, the recirculation exhaust gas is maintained at a high temperature, the oxidation of carbon and hydrocarbons contained in the recirculation exhaust gas is promoted and hence the deposition of deposits including carbon on the valve element and the walls of a valve case of the recirculation control valve can be suppressed.

Thus simple construction including the recirculation pipe extended close to the exhaust pipe suppresses the deposition of deposits including carbon in the recirculation control valve and prevents the recirculation control valve from becoming incapable of properly controlling the flow of the recirculation exhaust gas due to the deposition of deposits in the recirculation control valve.

In the exhaust gas recirculation system according to the first aspect of the present invention, both the recirculation pipe of the recirculation passage, and the exhaust pipe of the exhaust passage may be covered with a heat insulating cover. When both the recirculation pipe and the exhaust pipe are covered with the heat insulating cover, a hot atmosphere heated by heat radiated by the exhaust passage is created in a space enclosed by the heat insulating cover. Since the recirculation pipe is extended in the hot atmosphere, the amount of heat radiated by the recirculation pipe into the atmosphere is reduced, the drop of the temperature of the recirculation exhaust gas flowing through the recirculation pipe is suppressed and the oxidation of carbon and hydrocarbons contained in the recirculation exhaust gas is promoted. Consequently, the deposition of deposits including carbon on the valve element of the recirculation control valve and in the exhaust gas passage of the recirculation control valve can be suppressed. Thus simple construction including covering both the recirculation pipe and the exhaust pipe with the heat insulating cover enhances the aforesaid effect of the exhaust gas recirculation system.

According to a second aspect of the present invention, an exhaust gas recirculation system includes: a recirculation passage having one end connected to an exhaust passage included in an internal combustion engine and the other end connected to an intake passage included in the internal combustion engine to extract part of an exhaust gas as a recirculation exhaust gas from the exhaust passage and to recirculate the same to the intake passage; and a recirculation control valve placed in the recirculation passage to control the flow of the recirculation exhaust gas into the intake passage; wherein the internal combustion engine is mounted on a vehicle, an exhaust pipe forming a part of the exhaust passage is extended on a lower side of an engine body included in the internal combustion engine with respect to the direction of running wind, a recirculation pipe forming a part of the recirculation passage has an upper end connected to a part, facing the engine body, of the exhaust pipe, and the recirculation pipe has a heat retaining section extended in a space between the engine body and the exhaust pipe.

In the exhaust gas recirculation system according to the second aspect of the present invention, the heat maintaining section including the upper end of the recirculation pipe is disposed behind the engine body of the internal combustion engine mounted on the vehicle and is screened from the running wind that blows against the running vehicle by the engine body. Thus the heat retaining section is cooled scarcely by the running wind, a space screened from the running wind is formed between the engine body and the exhaust pipe, the space is heated by heat radiated by the exhaust pipe at a high temperature, and the heat retaining section including the upper end of the recirculation pipe is extended in the high-temperature space. Therefore, heat dissipation from the recirculation pipe into the atmosphere is small even if the recirculation pipe is long, the drop of the temperature of the recirculation exhaust gas is suppressed from the moment the recirculation exhaust gas is extracted from the exhaust passage, the oxidation of carbon and hydrocarbons contained in the recirculation exhaust gas is promoted and, hence, the deposition of deposits including carbon on the valve element of the recirculation control valve and in the exhaust gas passage of the recirculation control valve is suppressed.

According to a third aspect of the present invention, an exhaust gas recirculation system includes: a recirculation passage having one end connected to an exhaust passage included in an internal combustion engine and the other end connected to an intake passage included in the internal combustion engine to extract part of an exhaust gas as a recirculation exhaust gas from the exhaust passage and to recirculate the same to the intake passage; and a recirculation control valve placed in the recirculation passage to control the flow of the recirculation exhaust gas into the intake passage; wherein a recirculation pipe forming a part of the recirculation passage has a contact section extended along an exhaust pipe forming a part of the exhaust passage with its outer surface in contact with the outer surface of the exhaust pipe.

In the exhaust gas recirculation system in the third aspect of the present invention, the recirculation pipe has the contact section extended along the exhaust pipe with its outer surface in contact with the outer surface of the exhaust pipe. Therefore heat is transmitted from the exhaust pipe to the contact section, in contact with the exhaust pipe, of the recirculation pipe to suppress the drop of the temperature of the recirculation pipe, the area of the heat radiating surface of the recirculation pipe is reduced by the area of a part of the recirculation pipe in contact with the exhaust pipe, the drop of the temperature of the recirculation exhaust gas flowing through the recirculation pipe is suppressed and the oxidation of carbon and hydrocarbons contained in the recirculation exhaust gas is promoted. Consequently, the deposition of deposits including carbon on the valve element of the recirculation control valve and in the exhaust gas passage of the recirculation control valve is suppressed.

According to a fourth aspect of the present invention, an exhaust gas recirculation system includes: a recirculation passage having one end connected to an exhaust passage included in an internal combustion engine and the other end connected to an intake passage included in the internal combustion engine to extract part of an exhaust gas as a recirculation exhaust gas from the exhaust passage and to recirculate the same to the intake passage; and a recirculation control valve placed in the recirculation passage to control the flow of the recirculation exhaust gas into the intake passage; wherein the recirculation passage has an internal passage section formed inside an exhaust pipe forming a part of the exhaust passage and separated from the exhaust passage by a partition wall formed in the exhaust pipe.

In the exhaust gas recirculation system according to the fourth aspect of the present invention, heat of the exhaust gas flowing through the exhaust pipe is transmitted through the partition wall to the recirculation exhaust gas in the internal passage section. Therefore the drop of the temperature of the recirculation exhaust gas flowing through the recirculation passage is suppressed and the area of the heat radiating surface of the recirculation passage is reduced by an area corresponding to the internal passage section formed by placing the wall in the exhaust pipe. Thus the recirculation exhaust gas flowing through the recirculation passage is heated by the heat of the exhaust gas and heat dissipation from the recirculation passage into the atmosphere is suppressed even if the recirculation passage is long, the drop of the temperature of the recirculation exhaust gas flowing through the recirculation passage is suppressed and the oxidation of carbon and hydrocarbons contained in the recirculation exhaust gas is promoted. Consequently, the deposition of deposits including carbon on the valve element of the recirculation control valve and in the exhaust gas passage of the recirculation control valve is suppressed.

Since the internal passage section of the recirculation passage is formed in the exhaust pipe, a recirculation pipe forming the recirculation passage can be extended in a compact arrangement. Thus, simple construction including the recirculation passage having the internal passage section formed in the exhaust pipe simplifies the piping of an exhaust system, which enables the internal combustion engine to be formed in compact construction.

The internal combustion engine may be a multicylinder internal combustion engine provided with a plurality of cylinders, an exhaust manifold may be connected to the cylinders, an exhaust gas analyzer may be placed in the manifold, and the upper end of the recirculation passage may be positioned below the exhaust gas analyzer with respect to the flowing direction of the exhaust gas.

Since the upper end of the recirculation passage is located below the exhaust gas analyzer with respect to the flowing direction of the exhaust gas, it is possible to prevent the cylinders from exhausting at different rate and the resultant difference between the ratios of effect of the cylinders on a measured value measured by the exhaust gas analyzer.

According to a fifth aspect of the present invention, an exhaust gas recirculation system includes: a recirculation passage having one end connected to an exhaust passage included in an internal combustion engine and the other end connected to an intake passage included in the internal combustion engine to extract part of an exhaust gas as a recirculation exhaust gas from the exhaust passage and to recirculate the same to the intake passage; and a recirculation control valve placed in the recirculation passage to control the flow of the recirculation exhaust gas into the intake passage; wherein a section of a recirculation pipe forming a part of the recirculation passage and a section of an exhaust pipe forming a part of the exhaust passage are combined to form a double-wall pipe structure.

In the exhaust gas recirculation system according to the fifth aspect of the present invention, the heat of the exhaust gas is transferred to the recirculation exhaust gas through an inner wall of the double-wall pipe structure. Therefore, the drop of the temperature of the recirculation exhaust gas flowing through the recirculation pipe can be suppressed, the oxidation of carbon and hydrocarbons contained in the recirculation exhaust gas is promoted and, hence, the deposition of deposits on the valve element of the recirculation control valve and in the exhaust gas passage of the recirculation control valve is suppressed.

Since the section of the recirculation pipe is combined with the section of the exhaust pipe to form the double-wall pipe structure, the recirculation passage is compact and the piping of an exhaust system is simplified, which enables the internal combustion engine to be formed in compact construction.

In the exhaust gas recirculation system according to the fifth aspect of the present invention, the internal combustion engine may be a multicylinder internal combustion engine provided with a plurality of cylinders, an exhaust manifold may be connected to the cylinders, an exhaust gas analyzer may be placed in the manifold, the section of the recirculation pipe forms the inner wall of the double-wall pipe structure, and the upper end of the section of the recirculation pipe forming the inner wall of the double-wall pipe structure corresponding to the upper end of the recirculation passage may be located below the exhaust gas analyzer with respect to the flowing direction of the exhaust gas.

Since the section of the recirculation pipe is the inner wall of the double-wall pipe structure surrounded by an annular section of the exhaust passage, the section of the recirculation pipe is not exposed to the atmosphere and heat is transferred through the entire circumference of the section of the recirculation pipe, the drop of the temperature of the recirculation exhaust gas flowing through the recirculation pipe can be further effectively suppressed, the extraction of the exhaust gas as a recirculation exhaust gas can be prevented from making the ratios of effect of the cylinders on a measured value measured by the exhaust gas analyzer differ from each other, and the exhaust gas analyzer is able to provide data necessary for accurate air-fuel ratio control.

According to a sixth aspect of the present invention, an exhaust gas recirculation system includes: a recirculation passage having one end connected to an exhaust passage included in an internal combustion engine and the other end connected to an intake passage included in the internal combustion engine to extract part of an exhaust gas as a recirculation exhaust gas from the exhaust passage and to recirculate the same to the intake passage; and a recirculation control valve placed in the recirculation passage to control the flow of the recirculation exhaust gas into the intake passage; wherein the exhaust passage is provided with branch exhaust pipes connected to individual exhaust passages of a plurality of cylinders included in the internal combustion engine to carry exhaust gases discharged from the cylinders, and an exhaust gas colleting structure for collecting the exhaust gases discharged from the cylinders, the exhaust gas collecting structure is provided with a recirculation exhaust gas inlet through which part of the exhaust gas is extracted as a recirculation exhaust gas and to recirculate the same to the intake passage, an exhaust gas analyzer for analyzing the exhaust gas to provide data for estimating air-fuel ratio is placed in the exhaust gas collecting structure, and the recirculation exhaust gas inlet is formed at a position below the exhaust gas analyzer with respect to the flowing direction of the exhaust gas.

In the exhaust gas recirculation system according to the sixth aspect of the present invention, the exhaust gas analyzer is placed in the exhaust gas collecting structure to analyze a mixed exhaust gas of the exhaust gases discharged from all the cylinders, the ratios of effect of the cylinders on a measured value measured by the exhaust gas analyzer differ scarcely from each other. Since the recirculation exhaust gas inlet of the exhaust gas recirculation system is formed at a position below the exhaust gas analyzer with respect to the flowing direction of the exhaust gas, it is possible to prevent the cylinders from discharging exhaust gases at different rates and the resultant difference between the ratios of effect of the cylinders on a measured value measured by the exhaust gas analyzer due to the extraction of a large amount of the exhaust gas as the recirculation exhaust gas at a position below the exhaust gas analyzer with respect to the flowing direction of the exhaust gas. Consequently, accurate air-fuel ratio control can be achieved on the basis of the data provided by the exhaust gas analyzer, and the $NO_x$ concentration of the exhaust gas can be reduced and fuel consumption can be improved by the recirculation of the exhaust gas.

According to the sixth aspect of the present invention, the interior of the exhaust gas collecting structure may be divided by a partition wall into two intermediate collecting passages connected to two cylinder groups each including the cylinders that do not perform an exhaust stroke successively, and the exhaust gas analyzer may be disposed in a recess formed in the partition wall so as to straddle both the intermediate collecting passages.

Since the exhaust gas analyzer is disposed in the recess formed in the partition wall so as to straddle both the intermediate collecting passages respectively connected to the two groups of the cylinders, the partition wall enhances intake and exhaust efficiencies, the exhaust gas analyzer placed in a branching part of the exhaust passage is able to provide data not significantly affected by difference between the ratios of effect of the cylinders on a measured value measured by the exhaust gas analyzer, and the exhaust gas recirculation system having the exhaust gas analyzer disposed in the recess of the partition wall can be formed in compact construction. Since the exhaust gas analyzer is placed in the recess of the partition wall and a part of the exhaust gas analyzer lies in the partition wall, the exhaust gas analyzer is partly screened from the high-temperature exhaust gas by the partition wall, which extends the life of the exhaust gas analyzer.

In the exhaust gas recirculation system in the sixth aspect of the present invention, the recirculation control valve may be attached to an engine body included in the internal combustion engine, the recirculation exhaust gas inlet may be opened into one of the two intermediate collecting passages.

Thus, since the recirculation exhaust gas inlet opens into one of the two intermediate collecting passages, the recirculation exhaust gas inlet can be formed at a position above the joint of the two intermediate collecting passages with respect to the flowing direction of the exhaust gas, i.e., a position nearer to the engine body, so that the passage between the recirculation exhaust gas inlet and the recirculation control valve can be formed in a short length, heat dissipation of the recirculation gas in the passage can be suppressed and the recirculation gas can be maintained at a comparatively high temperature. Consequently, the deposition of deposits including carbon on the valve element of the recirculation control valve and in the exhaust gas passage of the recirculation control valve can be suppressed, and the clogging of the recirculation control valve by deposits and the resultant incapability of the recirculation control valve for desired flow control operation can be prevented.

DESCRIPTION OF THE PREFERRED EMBODIMENTS

Preferred embodiments of the present invention will be described hereinafter with reference to the accompanying drawings. An internal combustion engine provided with an exhaust gas recirculation system in a first embodiment according to the present invention is a straight four-cylinder spark-ignition four-stroke engine of a cylinder injection type provided with fuel injection valves each attached to a cylinder head and capable of injecting a fuel directly into a combustion chamber. The internal combustion engine is provided with an exhaust gas analyzer capable of sensing the oxygen concentration or the like of an exhaust gas and of providing a signal proportional to air-fuel ratio. The air-fuel ratio of an air-fuel mixture supplied to the internal combustion engine is controlled for lean-burn operation on the basis of the signal provided by the exhaust gas analyzer.

Figure 1:
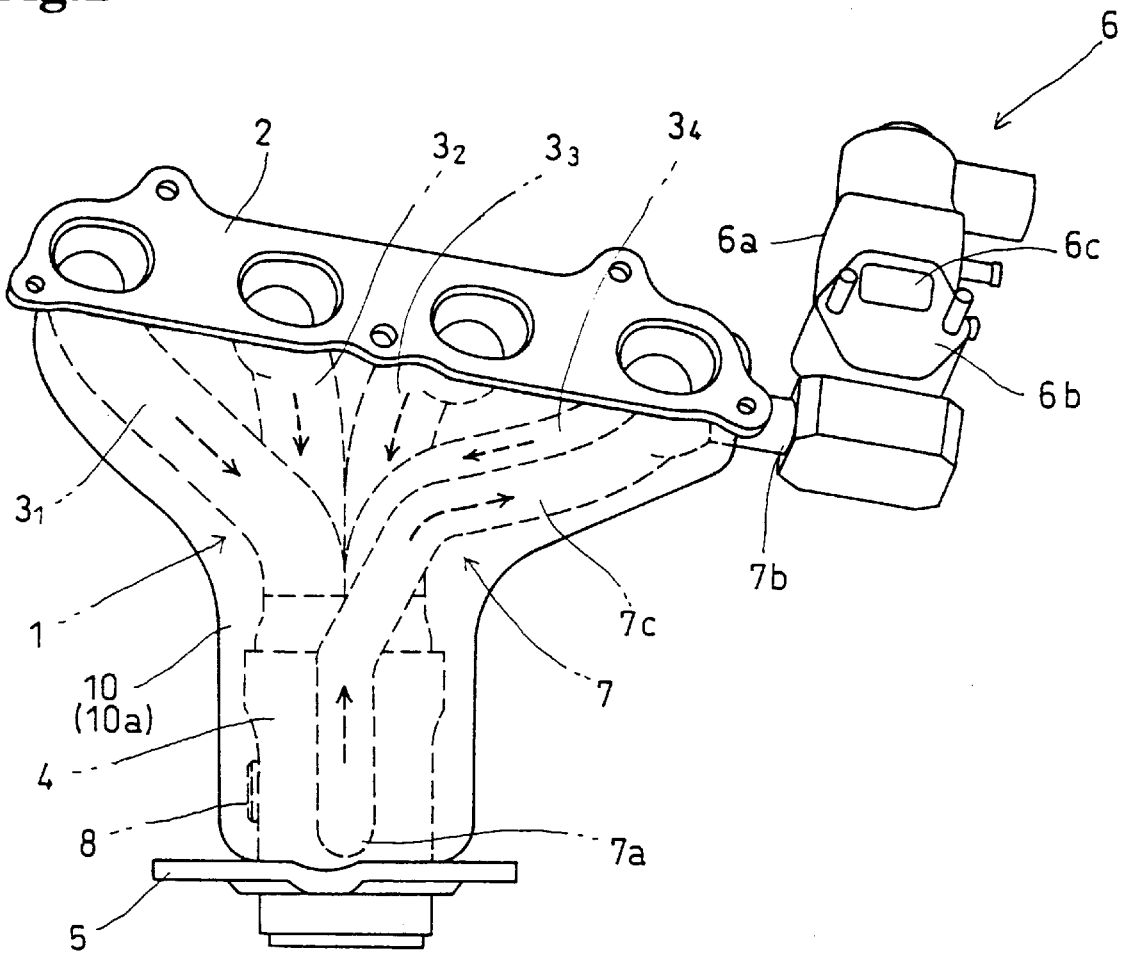
FIG. 1 is a front elevation of an exhaust manifold included in an internal combustion engine to which an exhaust gas recirculation system in a first embodiment according to the present invention is applied.
Figure 2:
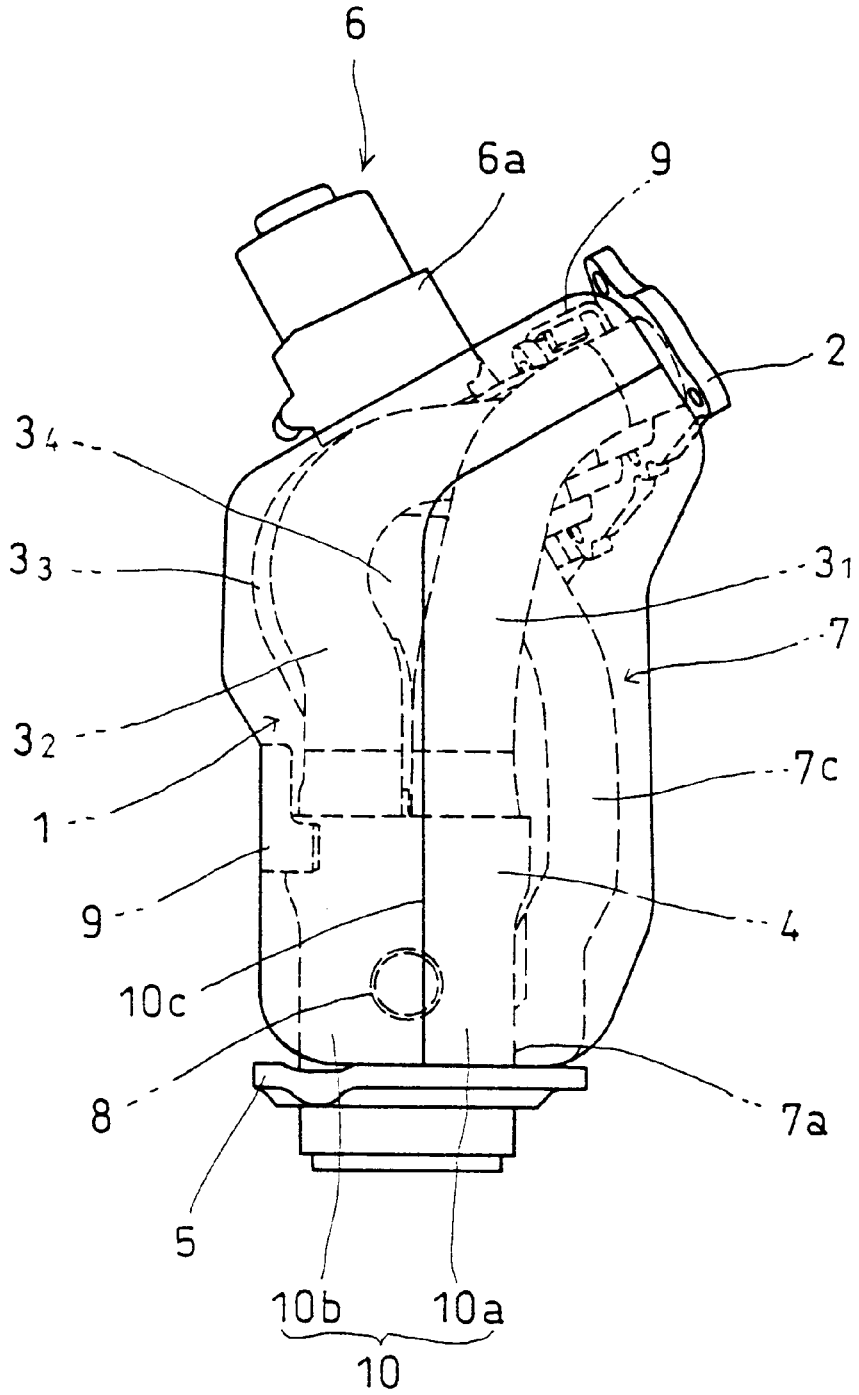
FIG. 2 is a side elevation of the exhaust manifold shown in FIG. 1.

As generally known, the internal combustion engine has an engine body formed by assembling component parts including an oil pan, a cylinder block, a cylinder head and a cylinder head cover, which are not shown. The cylinder head forms four combustion chambers together with four pistons axially slidably fitted in four cylinder bores formed in the cylinder block. The cylinder head is provided with an intake port and an exhaust port for each cylinder. The intake port and the exhaust port open into the combustion chamber. Each intake port has one end opening into the combustion chamber and closed by an intake valve, and the other end opening in a side surface of the cylinder head. A common flange formed at the free ends of four branch pipes of an intake manifold is fastened to the cylinder head to connect the intake ports to the four branch pipes of the intake manifold. The exhaust port has one end opening into the combustion chamber and closed by an exhaust valve, and the other end opening in a side surface of the cylinder head. A common flange 2 formed at the free ends of four branch pipes $\mathbf{3}_1$ to $\mathbf{3}_4$ of an exhaust manifold 1 shown in FIG. 1 is fastened to the cylinder head to connect the exhaust ports to the four branch pipes of the exhaust manifold 1.

The exhaust manifold 1 has the four branch pipes $\mathbf{3}_1$ to $\mathbf{3}_4$ and a collecting pipe 4. Exhaust gases discharged from the four cylinders flow through the four branch pipes $\mathbf{3}_1$ to $\mathbf{3}_4$ into the collecting pipe 4. The lower ends, with respect to the flowing direction of the exhaust gas, of the branch pipes $\mathbf{3}_1$ to $\mathbf{3}_4$ are arranged in two rows. The lower ends of the branch pipes $\mathbf{3}_1$ and $\mathbf{3}_4$ connected to the first and the fourth cylinder formed in the opposite end parts of the cylinder block are arranged in a row and are joined to the collecting pipe 4 at positions on the side of a position where the upstream end 7*a*, with respect to the flowing direction of a recirculation exhaust gas, of a recirculation pipe 7 is connected to the collecting pipe 4. The lower ends of the branch pipes $\mathbf{3}_2$ and $\mathbf{3}_3$ connected to the second and the third cylinder formed in a middle parts of the cylinder block are arranged in a row and are joined to the collecting pipe 4 at positions on a side opposite the side of the position of the upstream end 7*a* of the recirculation pipe 7 on the collecting pipe 4.

The collecting pipe 4 is provided with a flange 5. An exhaust pipe, not shown, has an upper end, with respect to the flowing direction of the exhaust gas connected to the flange 5 of the collecting pipe 4 and a lower end, with respect to the flowing direction of the exhaust gas, connected to a muffler, not shown. The exhaust gas discharged from the internal combustion engine flows through the exhaust ports, the exhaust manifold 1, the exhaust pipe and the muffler and is discharged into the atmosphere. An exhaust pipe structure including the exhaust manifold 1 and the exhaust pipe forms an exhaust passage in combination with the exhaust ports.

The exhaust gas recirculation system recirculates part of the exhaust gas as a recirculation exhaust gas to an intake passage. The exhaust gas recirculation system has an inflow passage, a recirculation control valve 6 and an outflow passage. The inflow passage and the outflow passage constitute an exhaust gas recirculation passage through which the recirculation exhaust gas is recirculated. The recirculation pipe 7 forms the inflow passage connecting the exhaust passage of the internal combustion engine and the recirculation control valve 6. The upstream end 7*a* (the upper end of the inflow passage) of the recirculation pipe 7 forms a recirculation exhaust gas inlet. The upstream end 7*a* of the recirculation pipe 7 is connected to the collecting pipe 4 at a position below a gas analyzer mounting hole 8, in which an exhaust gas analyzer is inserted, formed in the collecting pipe 4 at a position below the position where the lower ends of the branch pipes $\mathbf{3}_1$ to $\mathbf{3}_4$ are connected to the collecting pipe 4. The lower end, with respect to the flowing direction of the recirculation exhaust gas, of the recirculation pipe 7 is connected to an inlet port, not shown, formed in the valve case 6*a* of the recirculation control valve 6. Since the exhaust gas analyzer for measuring the oxygen concentration or the like of the exhaust gas is thus placed on the collecting pipe 4, a measured value measured by the exhaust gas analyzer is scarcely subject to the influence of difference in air-fuel ratio between air-fuel mixtures supplied to the four cylinders.

Part of the exhaust gas flowing through the collecting pipe 4 is extracted as a recirculation exhaust gas through the upstream end 7*a* of the recirculation pipe 7 thus connected to the collecting pipe 4 and hence it is possible to prevent making the ratios of effect the cylinders on the measured value measured by the exhaust gas analyzer due to difference between the cylinders in exhaust gas discharge rate.

The recirculation control valve 6 has a valve case 6*a* provided with a flange 6*b*. The flange 6*b* of the valve case 6*a* is fastened to a part of the side surface of the cylinder head, near the fourth branch pipe $\mathbf{3}_4$. The recirculation control valve 6 is provided with a valve element driven for movement by a dc motor or a stepping motor controlled by a controller, not shown. The opening of the recirculation control valve is controlled according to the operating condition of the internal combustion engine by a control signal provided by the controller to make the recirculation exhaust gas flow through the recirculation pipe 7 at a controlled flow rate into the intake passage.

The flange 6*b* of the recirculation control valve 6 is provided with an outlet port 6*c*. The outlet port 6*c* is connected to the outflow passage. The outflow passage essentially consists of head passages formed in the cylinder head, and a passage having an upper end connected to the head passages and a lower end connected to the intake passage.

The recirculation pipe 7 and the exhaust manifold 1 will be described in detail. A heat-insulation cover 10 is held on the exhaust manifold 1 by a holding member 9 so as to cover a part of the exhaust manifold 1 between the flanges 2 and 5. The heat-insulation cover 10 is split into two half covers 10*a* and 10*b* by a parting plane 10*c* extending in a direction in which the cylinders are arranged. The heat-insulation cover 10 suppresses the transfer of heat radiated by the exhaust manifold 1 to the ambient atmosphere. A space enclosed by the heat-insulation cover 10 is heated by heat radiated by the exhaust manifold in a high-temperature atmosphere. Thus the heat-insulation cover 10 serves as a heat retaining cover for the recirculation pipe 7.

The recirculation pipe 7 is extended in a space covered with the heat-insulation cover 10. The recirculation pipe 7 extends from the upstream end 7*a* along the axis of downstream end, with respect to the flowing direction of the exhaust gas, connected to the collecting pipe 4 at a position on the side of the upstream end 7*a* of the recirculation pipe 7. The recirculation pipe 7 has a hot section 7*c* extended close to the collecting pipe 4 and the fourth branch pipe $\mathbf{3}_4$. A section of the recirculation pipe 7, extending between an end of the hot section 7*c* on the side of the flange 2 and the downstream end 7*b* deviates from the fourth branch pipe $\mathbf{3}_4$ and is connected to the inlet port of the recirculation control valve 6.

The hot section 7*c* extends in a high-temperature atmosphere heated at a high temperature by heat radiated by the exhaust manifold 1 heated by the exhaust gas. The hot section 7*c* is disposed close to the exhaust manifold 1 such that the recirculation exhaust gas flowing through the recirculation pipe 7 is maintained at a temperature capable of promoting the oxidation of carbon and hydrocarbons (HCs) contained in the recirculation exhaust gas. Preferably, the hot section 7*c* of the recirculation pipe 7 is spaced the least possible distance apart from the exhaust pipe 1 such that the recirculation pipe 7 does not come into contact with the collecting pipe 4 or the fourth branch pipe $\mathbf{3}_4$ even if the same is caused to vibrate by vibratory force exerted thereon by the internal combustion engine or other devices.

The hot section 7*c* of the recirculation pipe 7 extends in the high-temperature atmosphere heated by heat radiated by the exhaust manifold 1. Consequently, the drop of the temperature of the recirculation exhaust gas extracted from the exhaust pipe 1 can be suppressed from the moment the recirculation exhaust gas is extracted and the oxidation of carbon and hydrocarbons contained in the recirculation exhaust gas is promoted. Since the fourth branch pipe $\mathbf{3}_4$ is extended along the surface of the collecting pipe 4*a* on the side of the position where the upstream end 7*a* is connected to the collecting pipe 4, the hot section 7*c* can be extended close to and along the collecting pipe 4 and the fourth branch pipe $\mathbf{3}_4$ without greatly bending the same.

The effect of the exhaust gas recirculation system in the first embodiment will be described.

The recirculation pipe 7 for carrying the recirculation exhaust gas extracted from the exhaust passage to the recirculation control valve 6 has the hot section 7*c* extended close to and along the collecting pipe 4 and the fourth branch pipe $\mathbf{3}_4$ and the hot section 7*c* of the recirculation pipe 7 extends in the high-temperature atmosphere heated by heat radiated by the collecting pipe 4 and the fourth branch pipe $\mathbf{3}_4$ heated by the exhaust gas. Consequently, heat dissipation from the recirculation pipe 7 into the atmosphere is reduced, the drop of the temperature of the recirculation exhaust gas in the recirculation pipe 7 can be suppressed, and hence the recirculation exhaust gas is maintained at a high temperature. Consequently, the oxidation of carbon and hydrocarbons contained in the recirculation exhaust gas by oxygen contained in the exhaust gas when the internal combustion engine is operating in a lean-burn mode is promoted and hence the deposition of deposits including carbon on the valve element of the recirculation control valve 6 and in the recirculation exhaust gas passages of the recirculation control valve 6 can be suppressed.

Thus the deposition of deposits including carbon on the valve element of the recirculation control valve 6 and in the passages of the recirculation control valve 6 can be suppressed simply by forming the hot section 7*c* in the recirculation pipe 7, and the recirculation control valve 6 is prevented from becoming incapable of functioning properly for desired flow control operation.

Since the hot section 7*c* extends from the upstream end 7*a* connected to the collecting pipe 4 to the lower end located near the joint of the fourth branch pipe $\mathbf{3}_4$ and the flange 2, the drop of the temperature of the recirculation exhaust gas extracted from the exhaust passage can be suppressed from the moment the recirculation exhaust gas is extracted to the moment the recirculation exhaust gas flows into the recirculation control valve 6. Since the recirculation exhaust gas is maintained at a high temperature for a comparatively long time, the oxidation of carbon and hydrocarbons contained in the recirculation exhaust gas is promoted and hence the deposition of deposits in the recirculation control valve 6 can be suppressed.

Since the recirculation pipe 7 and the exhaust manifold 1 are covered with the heat-insulation cover 10 extending between the flanges 2 and 5, the temperature of the space inside the heat-insulation cover 10 heated by the heat radiated by the exhaust manifold 1 is higher than that of a space around the recirculation pipe 7 and the exhaust manifold 1 when the same are not covered with any cover. Thus the heat-insulation cover 10 serves also as a heat retaining cover for the recirculation pipe 7. Since the recirculation pipe 7 extends in the high-temperature atmosphere, heat dissipation from the recirculation pipe 7 into the atmosphere is reduced, and the drop of the temperature of the recirculation exhaust gas in the recirculation pipe 7 can be suppressed. Consequently, the deposition of deposits including carbon in the recirculation control valve 6 can be suppressed simply by covering the recirculation pipe 7 and the exhaust manifold 1 with the heat-insulation cover 10.

Since the upstream end 7*a* of the recirculation pipe 7 is disposed below the exhaust gas analyzer inserted in the collecting pipe 4, it is possible to prevent the cylinders from exhausting at different rate and the resultant difference between the ratios of effect of the cylinders on a measured value measured by the exhaust gas analyzer.

Since the cylinders are thus prevented from exhausting at different rate and the difference between the ratios of effect of the cylinders on a measured value measured by the exhaust gas analyzer is thus prevented, the exhaust gas analyzer is able to analyze the exhaust gas accurately and the internal engine can be accurately controlled for lean-burn operation on the basis of measured data provided by the exhaust gas analyzer.

An exhaust gas recirculation system in a second embodiment according to the present invention will be described with reference to FIG. 3, in which parts like or corresponding to those of the exhaust gas recirculation system in the first embodiment are denoted by the same reference characters and the description thereof will be omitted. The exhaust gas recirculation system in the second embodiment is basically the same in construction as that in the first embodiment and differs from that in the first embodiment only in the positional relation between an exhaust manifold 1, an engine body 11 and a recirculation pipe 7. The exhaust gas recirculation system in the second embodiment is not provided with any member corresponding to the heat-insulation cover 10. The exhaust gas recirculation system in the second embodiment will be described principally in terms of the positional relation between the exhaust manifold 11, the engine body 11 and the recirculation pipe 7.

Figure 3:
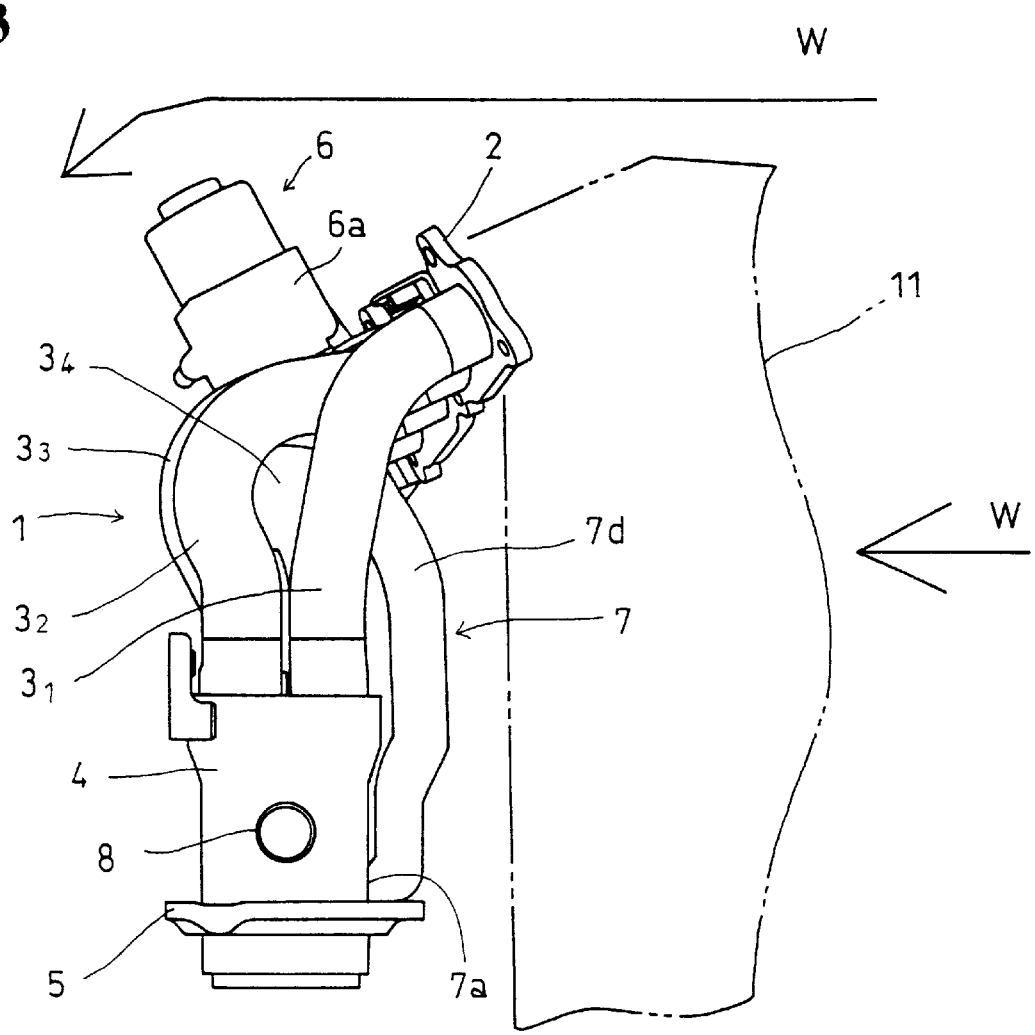
FIG. 3 is a front elevation of an exhaust manifold included in an internal combustion engine to which an exhaust gas recirculation system in a second embodiment according to the present invention is applied.

When the internal combustion engine is mounted on a vehicle, the exhaust manifold 1 is disposed behind the engine body 11 with respect to the flowing direction of running wind W indicated by the arrow W in FIG. 3. An upper end 7*a* of the recirculation pipe 7 is connected to a part of a collecting pipe 4 facing the engine body 11. Substantially entire length of the recirculation pipe 7 between the upper end 7*a* and the inlet port of a recirculation control valve 6 is extended behind the engine body 11 with respect to the flowing direction of running wind. A hot section 7*d* between the upper end 7*a* and a part near a flange 2 of the recirculation pipe 7 is extended in a space between the exhaust manifold 1 and the engine body 11.

The effect of the exhaust gas recirculation system in the second embodiment will be described.

The recirculation pipe 7 disposed substantially entirely behind the engine body 11 of the internal combustion engine is screened from running wind W that flows against the vehicle when the vehicle runs by the engine body 11 and hence the recirculation pipe 7 is cooled scarcely by running wind W. The space between the manifold 1 and the engine body 11 is screened from running wind W, the same space is heated at a high temperature by heat radiated by the exhaust manifold 1 to create a high-temperature atmosphere, and the hot section 7*d* of the recirculation pipe 7, between the upper end 7*a* and the part near the flange 2 is extended in the high-temperature atmosphere. Therefore, heat dissipation from the recirculation pipe 7 into the atmosphere is reduced, the drop of the temperature of the recirculation exhaust gas extracted from the exhaust pipe 1 can be suppressed from the moment the recirculation exhaust gas is extracted and the recirculation exhaust gas is maintained at a high temperature. Consequently, the oxidation of carbon and hydrocarbons contained in the recirculation exhaust gas is promoted and the deposition of deposits on the valve element of the recirculation control valve 6 and in the passage of the recirculation control valve 6. Thus the exhaust gas recirculation system in the second embodiment provided with a simple structure including the hot section 7*d* in the recirculation pipe 7 exercises the same effect as that exercised by the exhaust gas recirculation system in the first embodiment.

Figure 4:
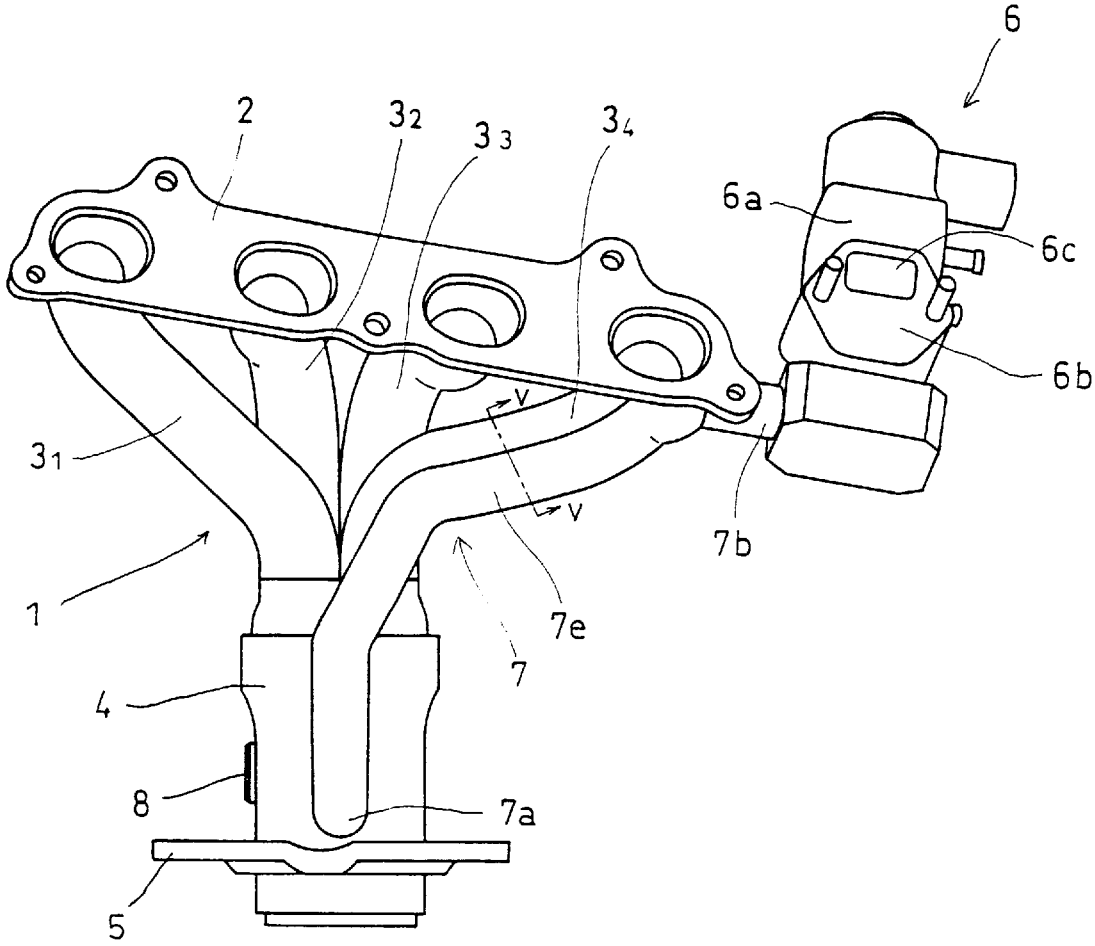
FIG. 4 is a front elevation of an exhaust manifold included in an internal combustion engine to which an exhaust gas recirculation system in a third embodiment according to the present invention is applied.
Figure 5:
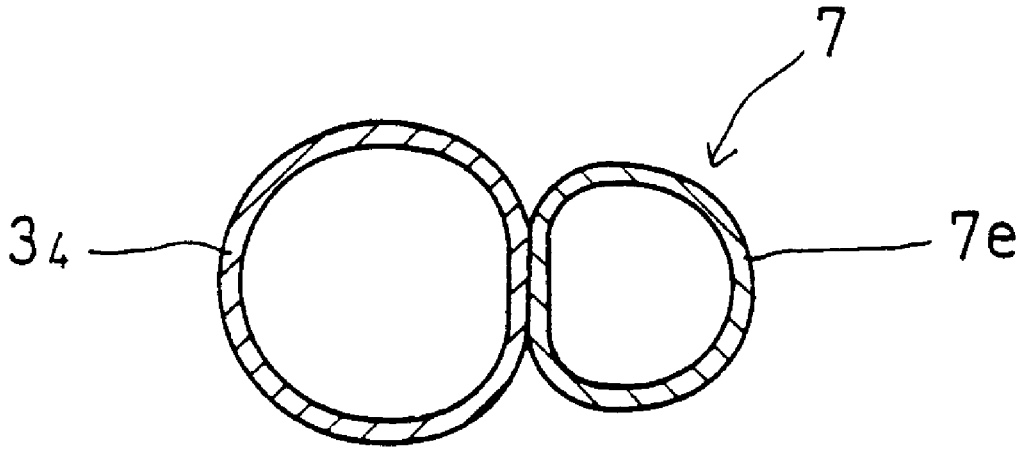
FIG. 5 is a sectional view taken on line V—V in FIG. 4.

An exhaust gas recirculation system in a third embodiment according to the present invention will be described with reference to FIGS. 4 and 5, in which parts like or corresponding to those of the exhaust gas recirculation system in the first embodiment are denoted by the same reference characters and the description thereof will be omitted. The exhaust gas recirculation system in the third embodiment is basically the same in construction as that in the first embodiment and differs from that in the first embodiment principally in the positional relation between a recirculation pipe 7 and a fourth branch pipe $\mathbf{3}_4$. The exhaust gas recirculation system in the third embodiment will be described principally in terms of the positional relation between the positional relation between the recirculation pipe 7 and the fourth branch pipe $\mathbf{3}_4$.

The recirculation pipe 7 is extended from a position near the flange 5 of a collecting pipe 4 along the collecting pipe 4 and the fourth branch pipe $\mathbf{3}_4$. A contact section 7*e* of the recirculation pipe 7 extending along the fourth branch pipe $\mathbf{3}_4$ is in contact with the fourth branch pipe $\mathbf{3}_4$ as shown in FIG. 5. A part of the contact section 7*e* in contact with the fourth branch pipe $\mathbf{3}_4$ is flattened to form a contact surface, and a part of the fourth branch pipe $\mathbf{3}_4$ in contact with the contact section 7*e* is flattened to form a contact surface so that the contact section 7*e* of the recirculation pipe 7 and the fourth branch pipe $\mathbf{3}_4$ are in two-dimensional contact with each other. The contact surface of the fourth branch pipe $\mathbf{3}_4$ extends from a position near the joint of the collecting pipe 4 and the fourth branch pipe $\mathbf{3}_4$ to a position near the flange 2. It is preferable that the contact surfaces of the contact section 7*e* of the recirculation pipe 7 and the fourth branch pipe $\mathbf{3}_4$ are formed in the largest possible area. With the recirculation pipe 7, it is preferable, in view of reducing heat dissipation from the recirculation pipe 7, that the area of the contact surface of the contact section 7*e* in contact with the fourth branch pipe $\mathbf{3}_4$ is greater than that of part of the surface of the recirculation pipe 7, exposed to the atmosphere.

The effect of the exhaust gas recirculation system in the third embodiment will be described.

Since the recirculation pipe 7 has the contact section 7*e* extending along the fourth branch pipe $\mathbf{3}_4$ in contact with the fourth branch pipe $\mathbf{3}_4$ in a range between the position near the joint of the fourth branch pipe $\mathbf{3}_4$ and the collecting pipe 4, and a position near the flange 2, heat is transferred from the fourth branch pipe $\mathbf{3}_4$ through the contact part 7*e* in contact with the fourth branch pipe $\mathbf{3}_4$ to the recirculation pipe 7. Thus the drop of the temperature of the recirculation pipe 7 is suppressed, and the area of the heat radiating surface of the recirculation pipe 7 is reduced by the area of the part of the contact section 7*e* in contact with the fourth branch pipe $\mathbf{3}_4$. Consequently, the recirculation pipe 7 receives heat from the fourth branch pipe $\mathbf{3}_4$, heat dissipation from the recirculation pipe 7 decreases, the drop of the temperature of the recirculation exhaust gas flowing through the recirculation pipe 7 is suppressed, the recirculation exhaust gas is maintained at a high temperature, the oxidation of carbon and hydrocarbons contained in the recirculation exhaust gas is promoted, and the deposition of deposits including carbon on the valve element of the recirculation control valve 6 and in the passage of the recirculation control valve 6 is suppressed. Thus the exhaust gas recirculation system in the third embodiment provided with a simple structure including the contact section 7*e* in the recirculation pipe 7 exercises the same effect as that exercised by the exhaust gas recirculation system in the first embodiment.

An exhaust gas recirculation system in a fourth embodiment according to the present invention will be described with reference to FIGS. 6 and 9, in which parts like or corresponding to those of the exhaust gas recirculation system in the first embodiment are denoted by the same reference characters and the description thereof will be omitted. The exhaust gas recirculation system in the fourth embodiment is basically the same in construction as that in the first embodiment and differs from that in the first embodiment principally in the construction of a recirculation passage and a fourth branch pipe $\mathbf{3}_4$. The exhaust gas recirculation system in the fourth embodiment will be described principally in terms of the construction of the recirculation passage and the fourth branch pipe $\mathbf{3}_4$.

Figure 7:
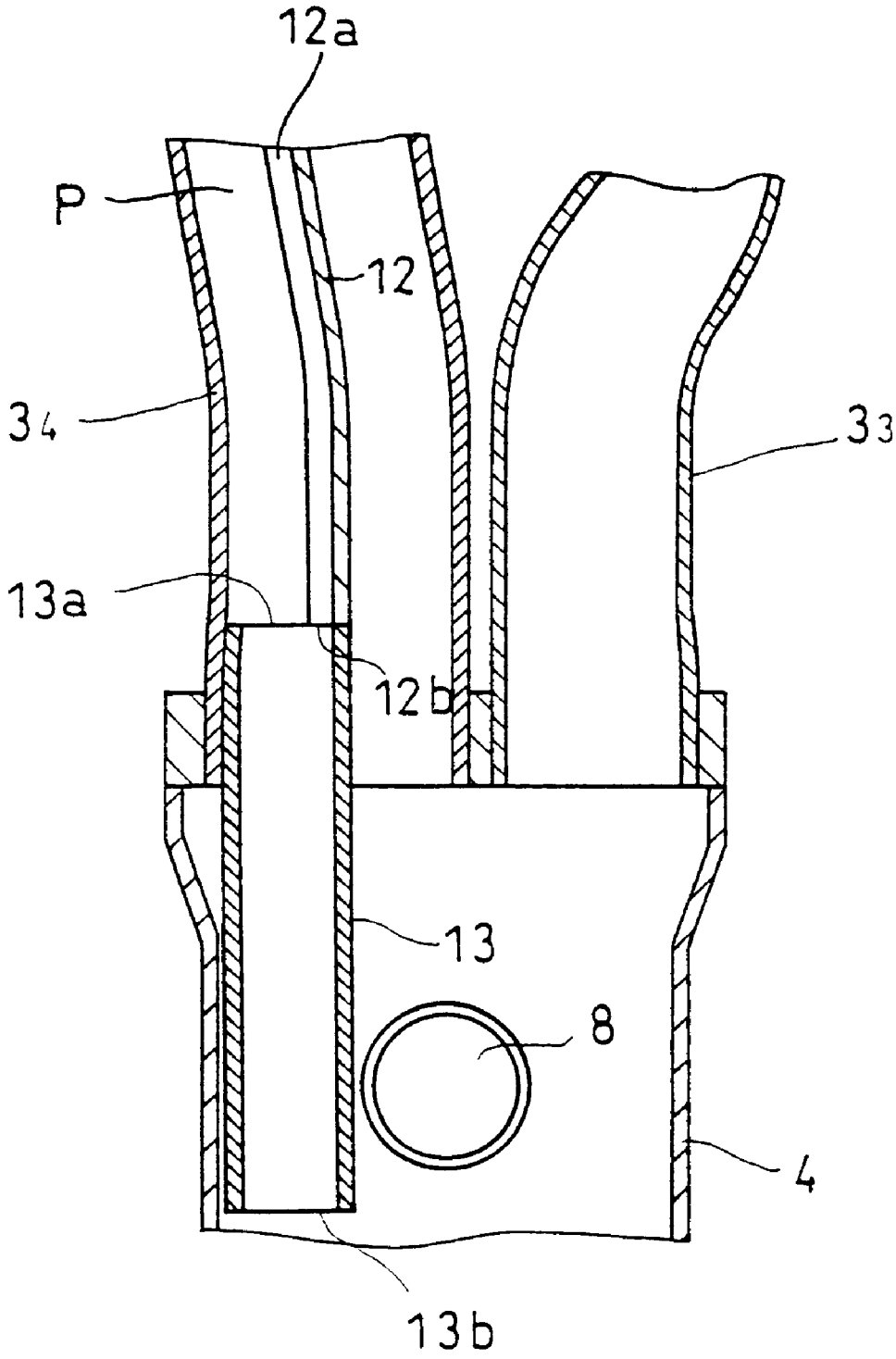
FIG. 7 is a sectional view of a part around the upper end of a recirculation passage of the exhaust gas recirculation system shown in FIG. 6.
Figure 8:
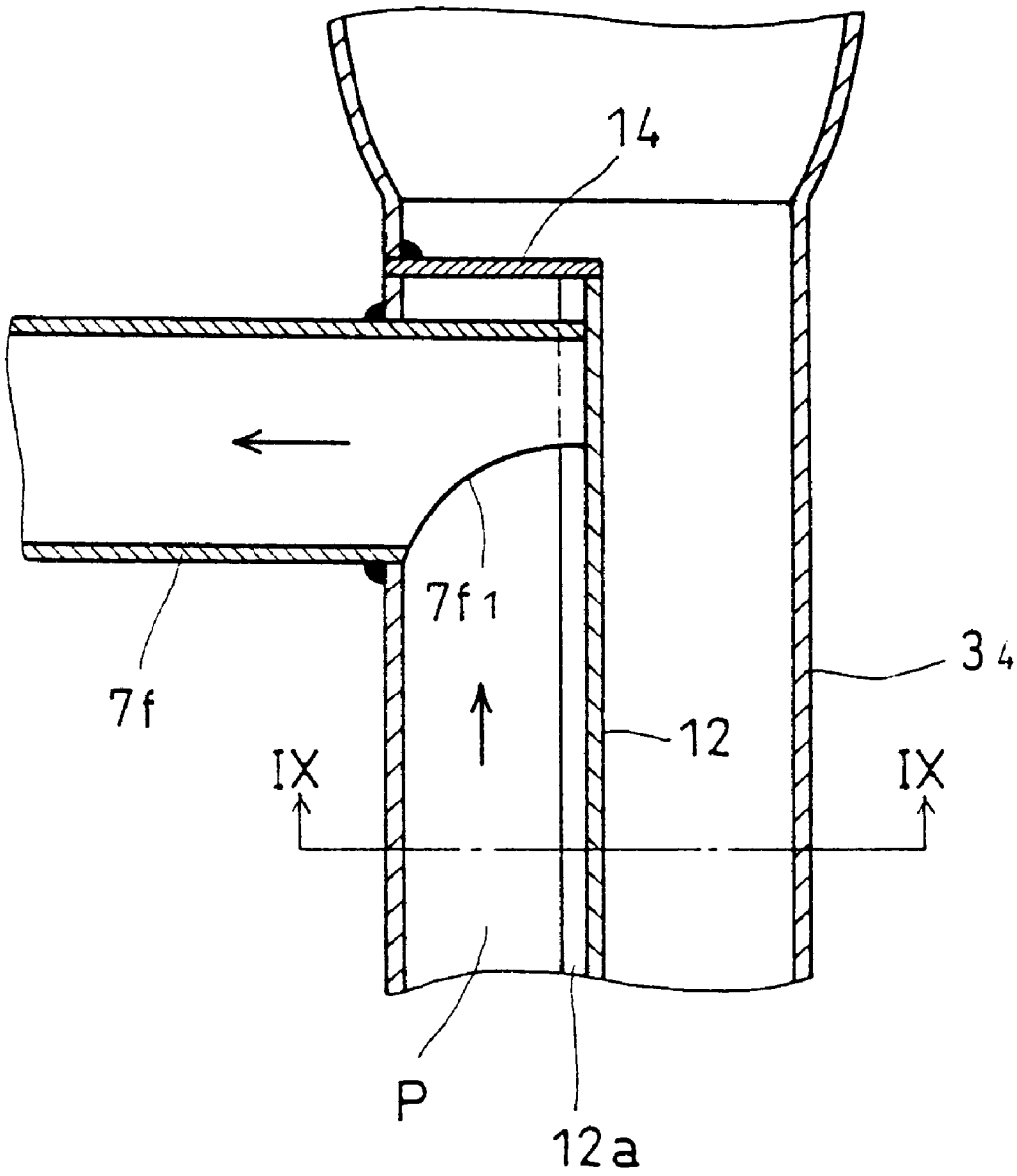
FIG. 8 is a sectional view of a part around the lower end of the recirculation passage of the exhaust gas recirculation system shown in FIG. 6.

The fourth branch pipe $\mathbf{3}_4$ of the fourth embodiment has an inside diameter greater than that of the fourth branch pipe $\mathbf{3}_4$ of the first embodiment. As shown in FIGS. 7 to 9, a partition plate 12 is placed inside the fourth branch pipe $\mathbf{3}_4$ to define an internal passage P separated from an exhaust passage in the fourth branch pipe $\mathbf{3}_4$. A pair of flanges 12*a* (FIG. 9) formed along the opposite side edges of the partition plate 12 are joined to the inner surface of the fourth branch pipe $\mathbf{3}_4$. The heat of the exhaust gas flowing through the exhaust passage in the fourth branch pipe $\mathbf{3}_4$ is transferred through the partition plate 12 to the recirculation exhaust gas flowing through the internal passage P.

As shown in FIG. 7, the upper end, with respect to the flowing direction of the recirculation exhaust gas, of the internal passage P is connected to a space in an extension pipe 13 extending into a collecting pipe 4. The upper end 13*a*, with respect to the flowing direction of the exhaust gas flowing through the exhaust passage, of the extension pipe 13 is in contact with the lower end 12*b*, with respect to the flowing direction of the exhaust gas flowing through the exhaust passage, of the partition plate 12 and the inner circumference of the fourth branch pipe $\mathbf{3}_4$. The lower end 13*b*, with respect to the flowing direction of the exhaust gas flowing through the exhaust passage, is located below, with respect to the flowing direction of the exhaust gas flowing through the exhaust passage, a gas analyzer mounting hole 8 formed in the collecting pipe 4. The lower end 13*b* of the extension pipe 13 corresponds to the upper end of the recirculation passage.

Figure 6:
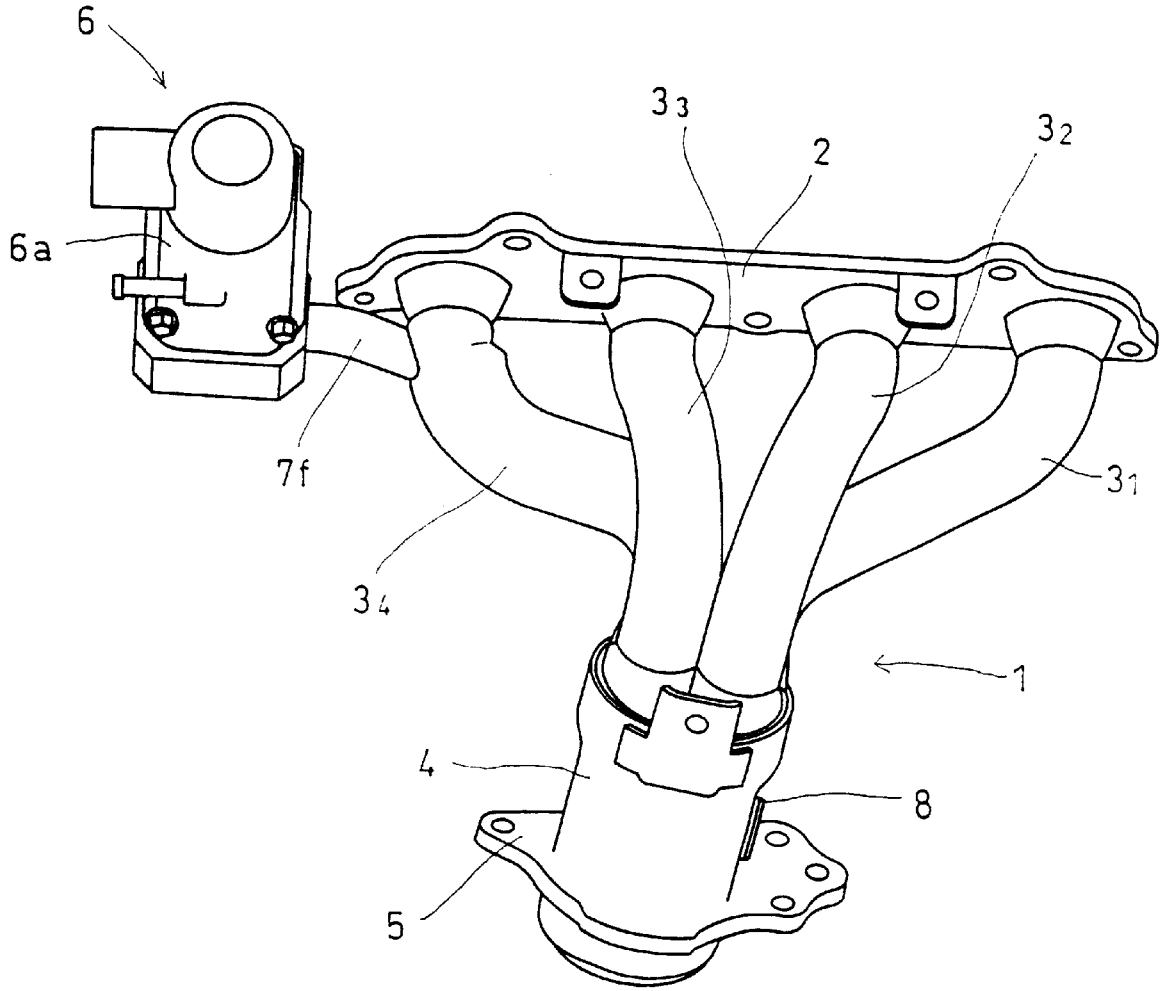
FIG. 6 is a rear view of an exhaust manifold included in an internal combustion engine to which an exhaust gas recirculation system in a fourth embodiment according to the present invention is applied.
Figure 9:
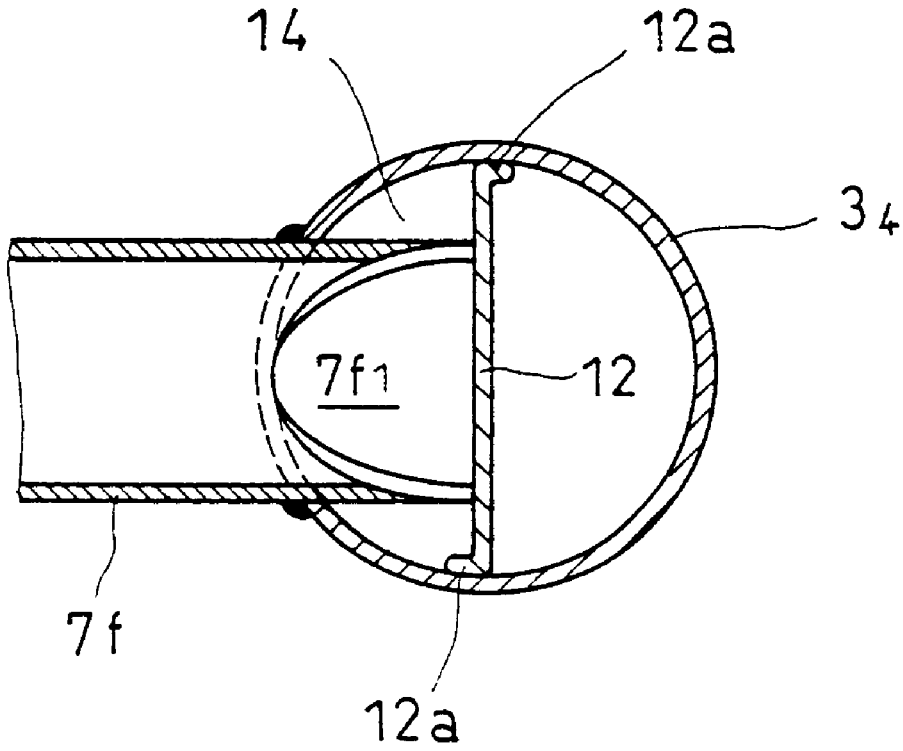
FIG. 9 is a sectional view taken on line IX—IX in FIG. 8.

Referring to FIGS. 6, 8 and 9, a connecting pipe 7*f* penetrates a part, near a flange 2, of the fourth branch pipe $\mathbf{3}_4$. The connecting pipe 7*f* has an upper end connected to the lower end of the internal passage P, and a lower end connected to the inlet port of a recirculation control valve 6. An end part of the round connecting pipe 7*f* corresponding to the upper end of the connecting pipe 7*f* is cut partly to form an opening $\mathbf{7}f_1$ opening in a direction opposite the flowing direction of the recirculation exhaust gas. A semicircular end plate 14 is attached to the inner circumference of the fourth branch pipe $\mathbf{3}_4$ and the upper end, with respect to the flowing direction of the exhaust gas, of the partition plate 12 to close the internal passage P.

The recirculation gas flows through the upper end of the internal passage P into the internal passage P and flows through the internal passage P and the connecting pipe 7*f* into the recirculation control valve 6. In the fourth embodiment, a part of the fourth branch pipe $\mathbf{3}_4$ and the partition plate 12 defining the internal passage P, the extension pipe 13 and the connecting pipe 7*f* constitute a recirculation pipe 7 defining a recirculation passage.

The effect of the exhaust gas recirculation system in the fourth embodiment will be described.

The heat of the exhaust gas is transferred through the partition plate 12 to the recirculation exhaust gas flowing through the internal passage P formed in the fourth branch pipe $\mathbf{3}_4$ and hence the drop of the temperature of the recirculation exhaust gas flowing through the recirculation passage is suppressed. Since the partition plate 12 forms a part of the recirculation passage, the recirculation pipe 7 has heat radiating surface of a small area exposed to the atmosphere. The recirculation exhaust gas flowing through the extension pipe 13 receives heat from the exhaust gas through the entire surface of the extension pipe 13. Thus, the recirculation exhaust gas flowing through the recirculation passage is heated by the exhaust gas, heat dissipation of from the recirculation passage into the atmosphere is reduced, the drop of the temperature of the recirculation exhaust gas flowing through the recirculation passage is further suppressed, the recirculation exhaust gas is maintained at a high temperature, the oxidation of carbon and hydrocarbons contained in the recirculation exhaust gas is promoted, and the deposition of deposits including carbon on the valve element of the recirculation control valve and in the passage of the recirculation control valve can be suppressed.

Since the major part of the recirculation passage is formed in the fourth branch pipe 34, the piping of the recirculation passage is compact, which is effective in forming the internal combustion engine in compact construction.

Figure 12:
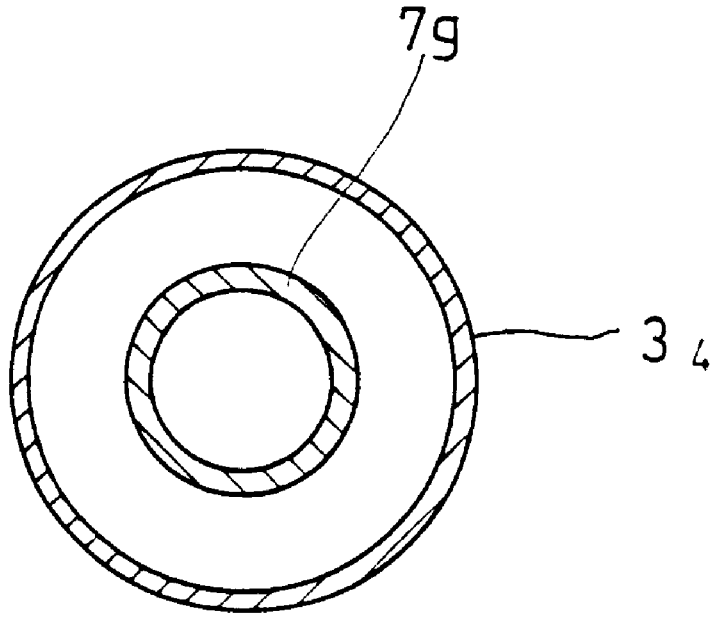
FIG. 12 is a sectional view taken on line XII—XII in FIG. 11.

An exhaust gas recirculation system in a fifth embodiment according to the present invention will be described with reference to FIGS. 6, 10 and 12, in which parts like or corresponding to those of the exhaust gas recirculation system in the fourth embodiment are denoted by the same reference characters and the description thereof will be omitted. The exhaust gas recirculation system in the fifth embodiment is basically the same in construction as that in the fourth embodiment and differs from that in the fourth embodiment principally in the construction of a recirculation passage. The exhaust gas recirculation system in the fifth embodiment will be described principally in terms of the construction of the recirculation passage.

A recirculation pipe 7 includes an inner pipe 7*g* extended in a fourth branch pipe $\mathbf{3}_4$. The inner pipe 7*g* is held in the fourth branch pipe $\mathbf{3}_4$ by holding projections 15 formed by staking at angular intervals on circles at proper longitudinal positions on the fourth branch pipe $\mathbf{3}_4$. The inner pipe 7*g* and the fourth branch pipe $\mathbf{3}_4$ form a double-wall pipe. An annular exhaust passage is formed between the inner pipe 7*g* and the fourth branch pipe $\mathbf{3}_4$. The heat of an exhaust gas flowing through the annular exhaust passage is transferred through the entire surface of the inner pipe 7*g* to a recirculation exhaust gas flowing through the inner pipe 7*g*.

Figure 10:
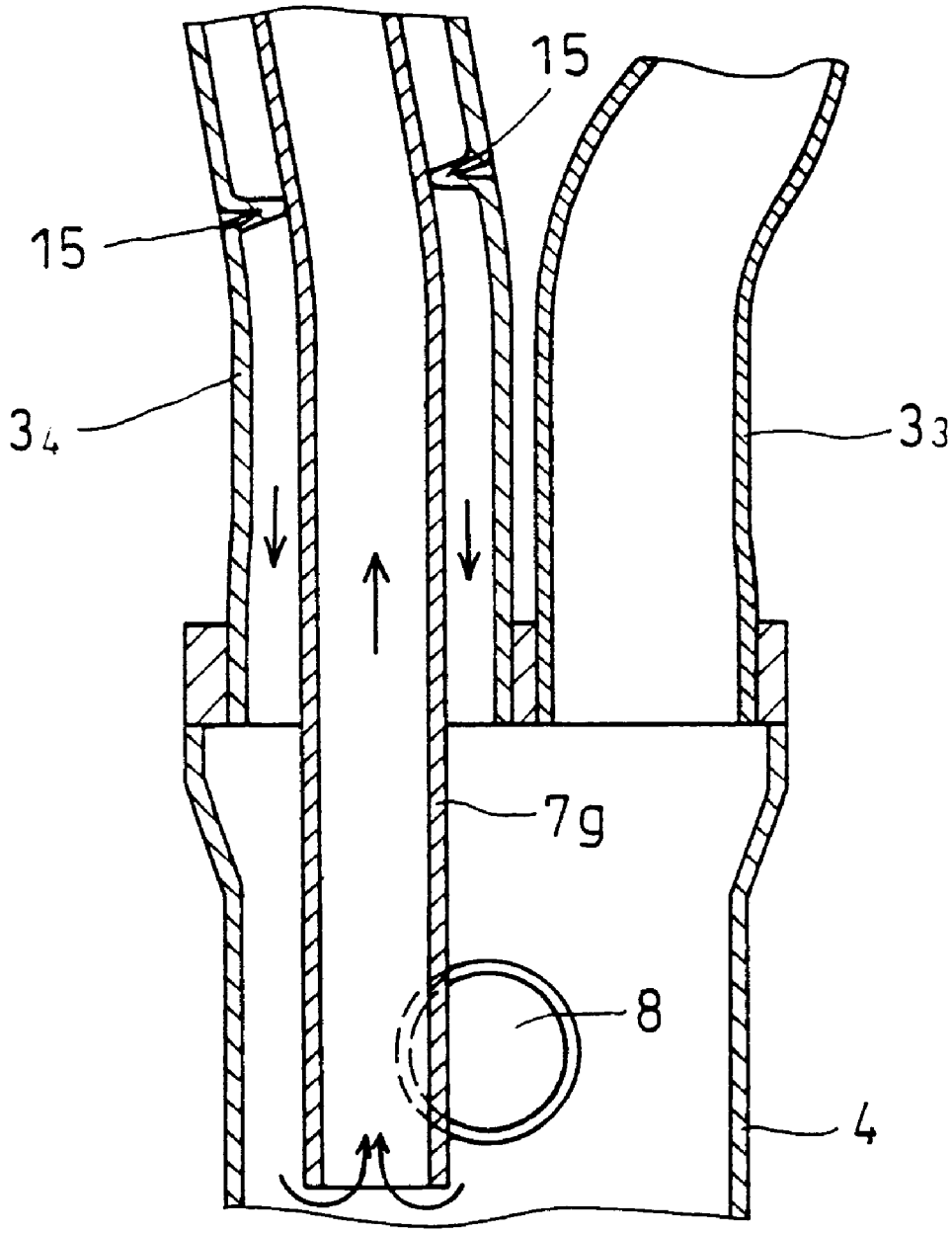
FIG. 10 is a sectional view of a part around the upper end of a recirculation passage of an exhaust gas recirculation system in a fifth embodiment according to the present invention.

As shown in FIG. 10, the inner pipe 7*g* of the recirculation pipe 7 extends downward, with respect to the flowing direction of the exhaust gas, beyond the lower end of the fourth branch pipe $\mathbf{3}_4$ into a collecting pipe 4, and the upper end, with respect to the flowing direction of the recirculation exhaust gas, of the inner pipe 7*g* is located below, with respect to the flowing direction of the exhaust gas, a gas analyzer mounting hole 8. The upper end of the inner pipe 7*g* corresponds to the upper end of the recirculation passage.

Figure 11:
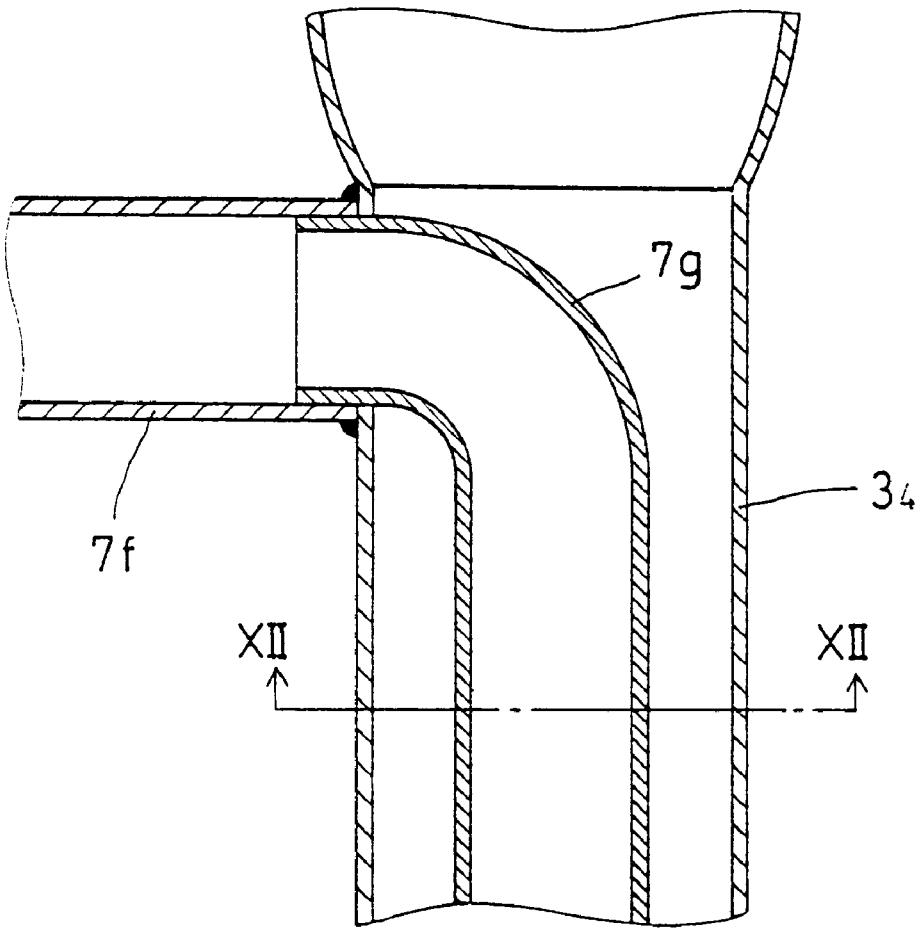
FIG. 11 is a sectional view of a part around the lower end of the recirculation passage of the exhaust gas recirculation system shown in FIG. 10.

As shown in FIG. 11, a lower end part of the inner pipe 7*g*, near a flange 2 attached to the upper end of the fourth branch pipe $\mathbf{3}_4$ is bent so as to extend perpendicularly to the fourth branch pipe $\mathbf{3}_4$ and to project outside from the fourth branch pipe $\mathbf{3}_4$ into a connecting pipe 7*f* attached to the outer surface of the fourth branch pipe $\mathbf{3}_4$. The lower end of the connecting pipe 7*f* is connected to the inlet port of a recirculation control valve 6.

The recirculation exhaust gas flows through the upper end into the inner pipe 7*g*, flows through the inner pipe 7*g* and the connecting pipe 7*f* into the recirculation control valve 6. The inner pipe 7*g* and the connecting pipe 7*f* form a recirculation pipe 7.

The effect of the exhaust gas recirculation system in the fifth embodiment will be described.

A section of the recirculation pipe 7, forming a double-wall pipe together with the fourth branch pipe $\mathbf{3}_4$, i.e., the inner pipe 7*g*, is surrounded by the annular exhaust passage and is not exposed to the atmosphere, and hence the inner tube 7*g* is exposed entirely to the heat of the exhaust gas. Therefore the temperature of the recirculation exhaust gas flowing through the recirculation pipe 7 drops very slightly. Since the inner pipe 7*g* of the recirculation pipe 7, surrounded by the annular exhaust passage is exposed entirely to the heat of the exhaust gas, the drop of the temperature of the recirculation exhaust gas flowing through the recirculation pipe 7 is further effectively suppressed and the recirculation exhaust gas is maintained at a high temperature. Consequently, the oxidation of carbon and hydrocarbons contained in the recirculation exhaust gas is promoted and the deposition of deposits including carbon on the valve element of the recirculation control valve 6 and in the passage of the recirculation control valve 6 is suppressed.

Since the recirculation passage is formed inside the fourth branch pipe $\mathbf{3}_4$ the piping of the recirculation passage is compact and the piping of the exhaust system is compact. Thus the exhaust gas recirculation system in the fifth embodiment provided with a simple structure including the inner pipe 7*g* in the recirculation pipe 7 exercises the same effect as that exercised by the exhaust gas recirculation system in the fourth embodiment.

Changes and variations that may be made in the exhaust gas recirculation systems in the foregoing embodiments will be described hereinafter.

Although the partition wall 12 employed in the fourth embodiment is a plat plate, the partition plate 12 may be a curved plate or may be formed integrally with the fourth branch pipe $\mathbf{3}_4$.

Although the upper end of the recirculation pipe 7 (recirculation passage) is on the exhaust manifold 1 in each of the foregoing embodiments, the same may be on an exhaust pipe connected to the lower end of the exhaust manifold 1. The internal combustion engine may be a multicylinder internal combustion engine other than the four-cylinder internal combustion engine.

Although the internal combustion engine mentioned in connection with the foregoing embodiments is a lean-burn internal combustion engine which controls air-fuel ratio on the basis of data provided by the exhaust gas analyzer, the same may be a spark-ignition internal combustion engine not using any exhaust gas analyzer or a compression-ignition internal combustion engine. When the internal combustion engine is not provided with any exhaust gas analyzer, in the fourth embodiment, the upper end of the internal passage P may be at any optional position in the collecting pipe 4; the internal passage P may be defined by a partition wall extended to the lower end, with respect to the flowing direction of the exhaust gas, of the fourth branch pipe $\mathbf{3}_4$, and the upper end, with respect to the flowing direction of the recirculation exhaust gas, of the recirculation passage may coincide with the lower end of the partition wall. Similarly, in the fifth embodiment, the upper end of the inner pipe 7*g* may be at an optional position in the collecting pipe 4, such as a position coinciding with the lower end of the fourth branch pipe $\mathbf{3}_4$.

In the fifth embodiment, the inner pipe 7*g* surrounded by the annular exhaust passage forms a section of the recirculation passage. If the exhaust gas recirculation system is applied to a spark-ignition internal combustion engine not using the exhaust gas analyzer, an annular space formed by extending the fourth branch pipe in an outer tube may be used as a recirculation passage. The upper end of this annular recirculation passage is at a position on the upper side, with respect to the flowing direction of the exhaust gas, of the lower end of the fourth branch pipe or coinciding with the lower end of the fourth branch pipe. When the recirculation passage is thus formed, the heat of the exhaust gas flowing through the fourth branch pipe heats the recirculation exhaust gas flowing through the annular recirculation passage, but the recirculation exhaust gas dissipates heat through the outer pipe exposed to the atmosphere. Therefore it is preferable that the exhaust manifold 1, similarly to that of the first embodiment, is covered with a heat-insulation cover 10.

The exhaust gas analyzer is a linear gas analyzer that provides a signal proportional to the oxygen concentration of the exhaust gas. The air-fuel ratio of an air-fuel mixture to be supplied to the cylinders is controlled on the basis of the output signal of the exhaust gas analyzer for lean-burn operation to improve fuel consumption.

A measured value provided by an exhaust gas analyzer included in a multicylinder internal combustion engine must reflect equally the respective compositions of the exhaust gases respectively discharged from the plurality of cylinders. Therefore the exhaust gas analyzer is placed in the collecting pipe in which all the exhaust gases discharged from the plurality of cylinders are mixed. When the multicylinder internal combustion engine is provided with an exhaust gas recirculation system, the position of a recirculation exhaust gas inlet through which the recirculation exhaust gas is extracted from the exhaust system affects a measured value provided by the exhaust gas analyzer placed in the collecting pipe, and difference between the ratios of effect of the cylinders on the measured value provided by the exhaust gas analyzer increases if the recirculation exhaust gas inlet is improperly positioned and, consequently, it is difficult to achieve the highly accurate control of air-fuel ratio.

If the recirculation exhaust gas inlet is formed at a position on the upper side of the exhaust gas analyzer, such as a position on the branch pipe of the exhaust manifold or a position near the joint of the collecting pipe and the branch pipes, the recirculation exhaust gas extracted through the recirculation exhaust gas inlet or the major part of the same recirculation exhaust gas contains only the exhaust gas discharged from the particular cylinder connected to the branch pipe in or near which the recirculation exhaust gas inlet is formed. Consequently, the amount of the exhaust gas discharged from the particular cylinder and reaches the exhaust gas analyzer is smaller than those of the exhaust gases discharged from the rest of the cylinders and hence the ratios of effect of the cylinders on a measured value measured by the exhaust gas analyzer of the exhaust gas discharged from the particular cylinder is smaller than those of the exhaust gases discharged from the rest of the cylinders. Such a condition is significant when the exhaust gas is recirculated at a high rate.

An exhaust gas recirculation system in a sixth embodiment according to the present invention is capable of preventing the extraction of an exhaust gas from an exhaust passage as a recirculation exhaust gas from making the ratios of effect of the cylinders on a measured value measured by an exhaust gas analyzer differ from each other, of extending the life of the exhaust gas analyzer and of suppressing the deposition of deposits in a recirculation control valve included therein.

An exhaust gas recirculation system in a sixth embodiment according to the present invention will be described with reference to FIGS. 13 to 15, in which parts like or corresponding to those of the foregoing embodiments are denoted by the same reference characters and the description thereof will be omitted. The exhaust gas recirculating system is incorporated into a straight four-cylinder spark-ignition four-stroke engine of a cylinder injection type provided with fuel injection valves each attached to a cylinder head and capable of injecting a fuel directly into a combustion chamber.

The firing order of the internal combustion engine is order of the first, the second, the fourth and the third cylinder. The respective exhaust strokes of the first and the fourth cylinder are not successive, and the respective exhaust strokes of the second and the third cylinders are not successive. The first and the fourth cylinder are included in a first cylinder group, and the second and the third cylinder are included in a second cylinder group.

The interior of a collecting pipe (collecting part) 4 is divided into a first intermediate collecting passage $\mathbf{26}_1$ and a second intermediate collecting passage $\mathbf{26}_2$ by a partition plate 25. A first branch pipe $\mathbf{3}_1$ and a fourth branch pipe $\mathbf{3}_4$ of an exhaust manifold 1, connected to the cylinders of the first cylinder group are connected to the first intermediate collecting passage $\mathbf{26}_1$. A second branch pipe $\mathbf{3}_2$ and a third branch pipe $\mathbf{3}_3$ of the exhaust manifold 1, connected to the cylinders of the second cylinder group are connected to the second intermediate collecting passages $\mathbf{26}_2$.

The collecting pipe 4 is provided with a gas analyzer mounting hole 27. An exhaust gas analyzer 28 for analyzing the exhaust gas to provide data for controlling the air-fuel ratio of an air-fuel mixture to be supplied into the combustion chambers of the cylinders is fitted in the gas analyzer mounting hole 27.

Figure 15:
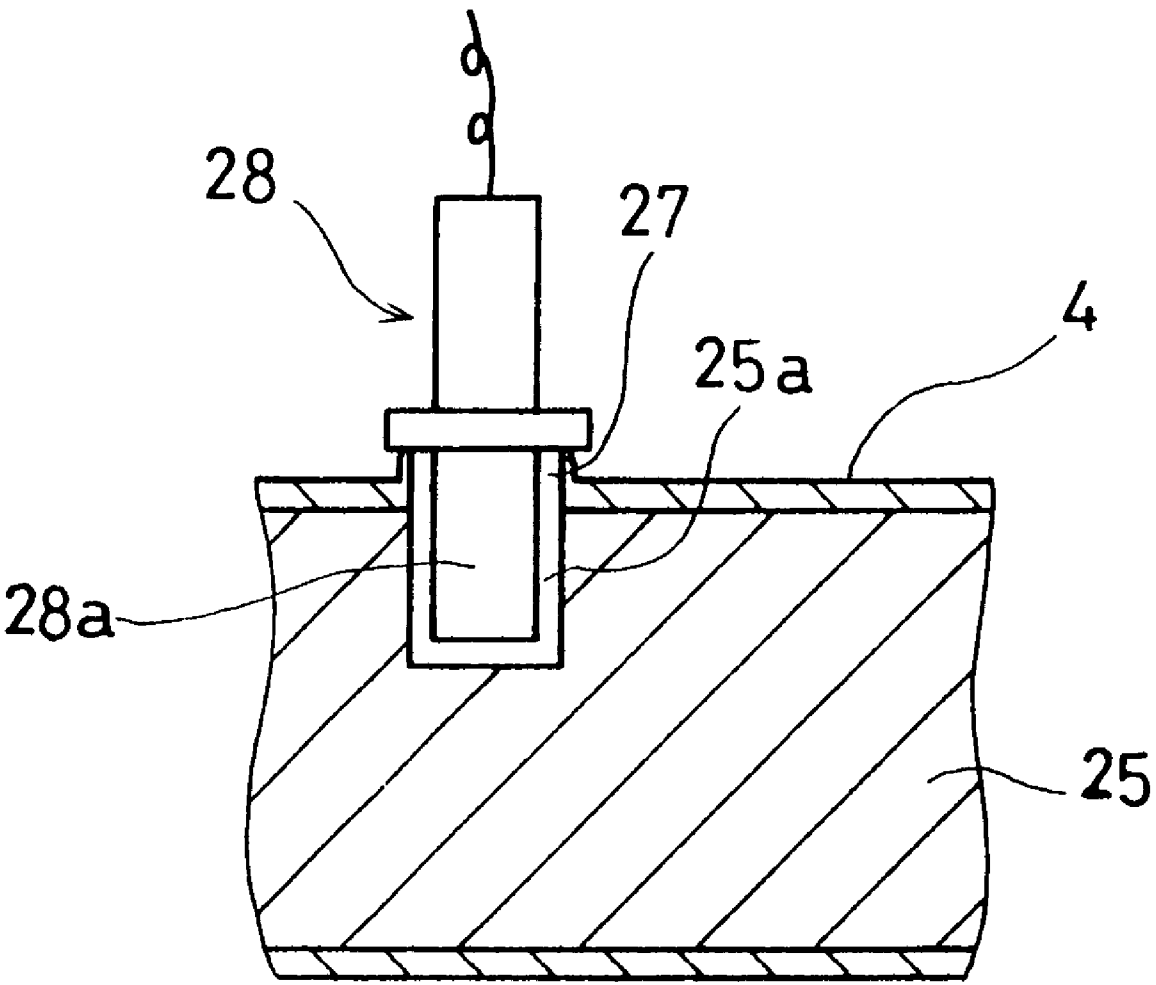
FIG. 15 is a sectional view of the exhaust manifold shown in FIG. 13, provided with an exhaust gas analyzer, taken on line XV—XV in FIG. 14.

As shown in FIG. 15, the partition plate 25 is provided with a recess 25*a* in a part thereof corresponding to the gas analyzer mounting hole 27. A measuring head 28*a* of the gas analyzer 18 inserted in the exhaust passage in the collecting pipe 4 is received closely in the recess 25*a* such that the measuring head 28*a* straddle both the intermediate collecting passages $\mathbf{26}_1$ and $\mathbf{26}_2$. Thus, the measuring head 28*a* of the exhaust gas analyzer 28 lies in both the intermediate collecting passages $\mathbf{26}_1$ and $\mathbf{26}_2$, so that the exhaust gas analyzer 28 measures the compositions of the exhaust gases discharged from the first and the fourth cylinder and flowing through the first intermediate passage $\mathbf{26}_1$ and those of the exhaust gases discharged from the second and the third cylinder and flowing through the second intermediate collecting passage $\mathbf{26}_2$; that is, the exhaust gas analyzer 28 measures the composition of a mixture of the exhaust gases discharged from all the cylinders.

The exhaust gas analyzer 28 is a linear gas analyzer that provides a signal proportional to the oxygen concentration of the exhaust gas. The air-fuel ratio of an air-fuel mixture to be supplied to the cylinders is controlled on the basis of the output signal of the exhaust gas analyzer 28 to supply a lean mixture to the cylinders for lean-burn operation in a specific operating range of the internal combustion engine.

Since the exhaust gas analyzer 28 is placed in the exhaust passage of the collecting pipe 4 in which the exhaust gases discharged from the first to the fourth cylinder are mixed, the ratios of effect of the cylinders on the measured value measured by the exhaust gas analyzer 28 are scarcely different from each other.

The interior of the collecting pipe 4 is divided into the first intermediate collecting passage $\mathbf{26}_1$ and the second intermediate collecting passage $\mathbf{26}_2$, the branch pipes of the exhaust manifold 1 connected to the first cylinder group, the respective exhaust strokes of the cylinders of which are not successive, are connected to the first intermediate collecting passage $\mathbf{26}_1$ and the branch pipes of the exhaust manifold 1 connected to the second cylinder group, the respective exhaust strokes of the cylinders of which are not successive, are connected to the second intermediate collecting passage $\mathbf{26}_2$. Thus, exhaust gas interference is suppressed, and intake and exhaust efficiencies can be enhanced. The exhaust gas analyzer 28 placed in a section including the intermediate collecting passages $\mathbf{26}_1$ and $\mathbf{26}_2$ of the exhaust passage is able to provide a measured value not affected by difference between the ratios of effect of the cylinders on a measured value measured by the exhaust gas analyzer 28. The exhaust gas analyzer 28 is placed in the recess 25*a* of the partition plate 25 to form a compact structure. Since the measuring head 28*a* of the exhaust gas analyzer 28 is placed in the recess 25*a* of the partition plate 25 and a part of the measuring head 28*a* lies in the partition plate 25, the measuring head 28*a* is partly screed from the high-temperature exhaust gas by the partition plate 25.

Figure 13:
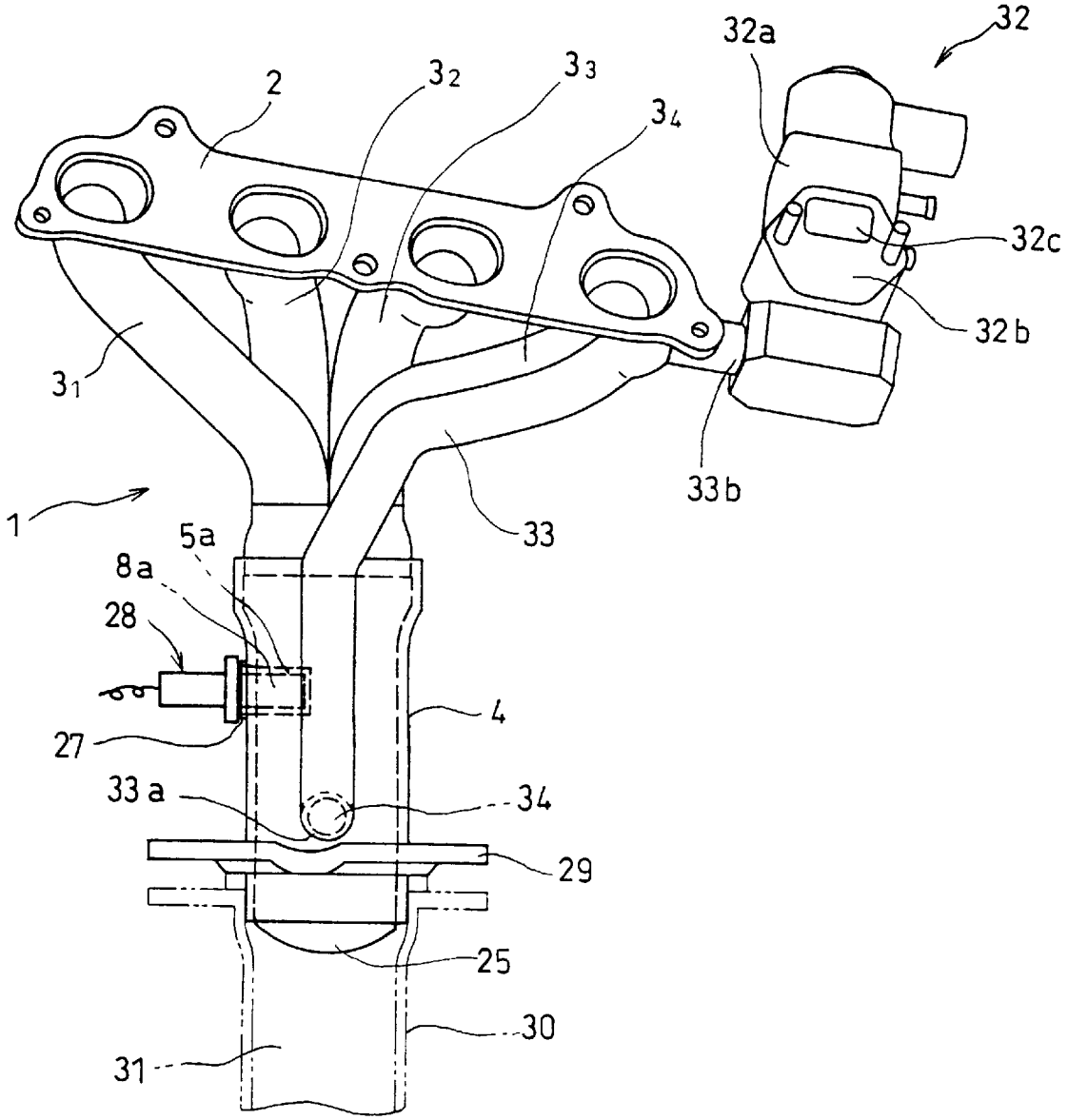
FIG. 13 is a front elevation of an exhaust manifold included in an exhaust gas recirculation system in a sixth embodiment according to the present invention.
Figure 14:
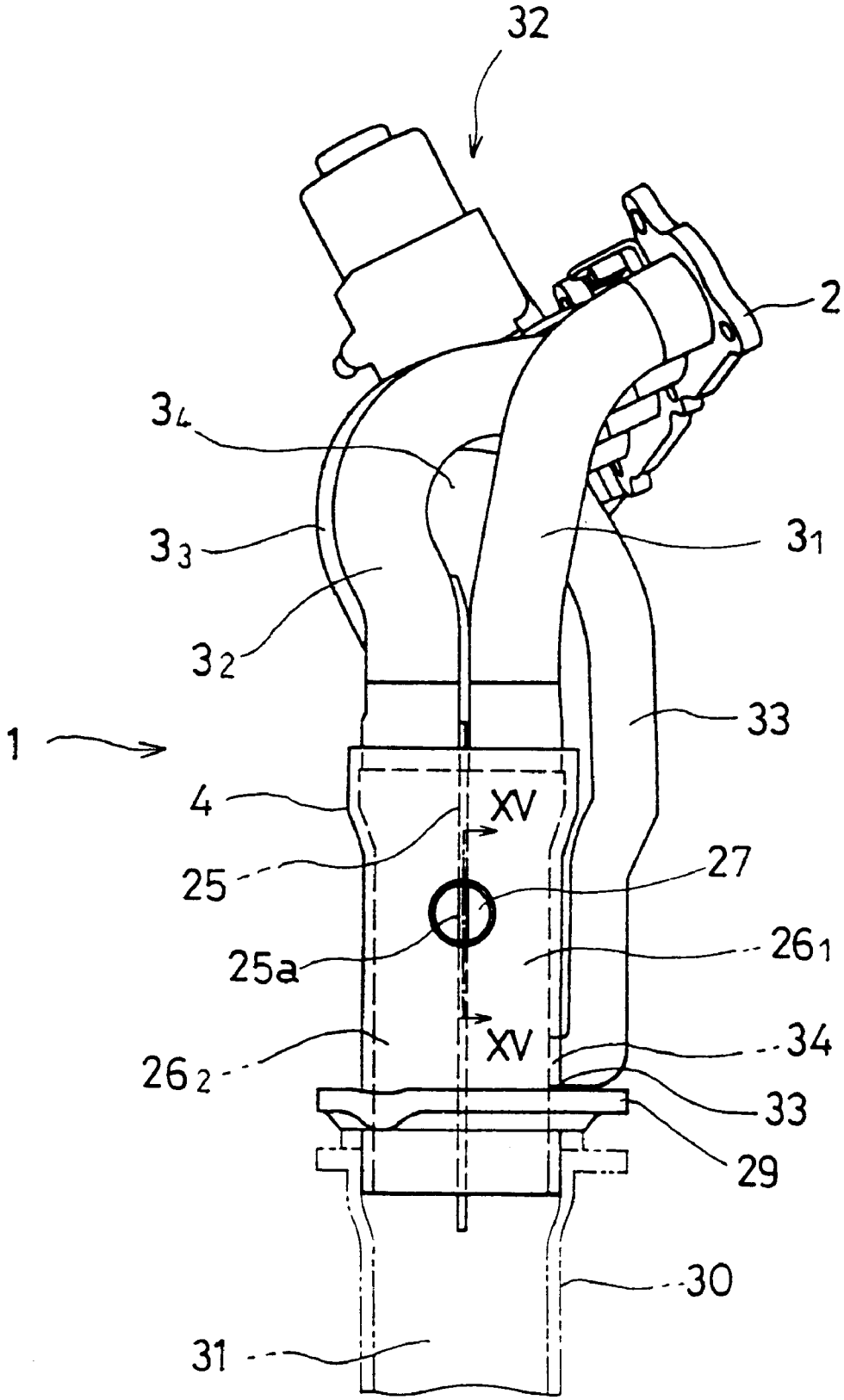
FIG. 14 is a side elevation of the exhaust manifold shown in FIG. 13, in which exhaust gas analyzer is removed.

Referring to FIGS. 13 and 14, a flange 29 formed on the collecting pipe 4 is connected to an exhaust pipe 30 having a lower end connected to a muffler, not shown. The intermediate collecting passages $\mathbf{26}_1$ and $\mathbf{26}_2$ merge into a lower collecting passage 31 defined by the exhaust pipe 30. The exhaust gas discharged from each combustion chamber flows through the exhaust port, the exhaust manifold 1, the exhaust pipe 30 and the muffler and is discharged into the atmosphere. The exhaust manifold 1, the exhaust pipe 30 and the muffler constitute an exhaust system. The exhaust system and the exhaust ports form an exhaust passage for the internal combustion engine.

The exhaust gas recirculation system that recirculates part of the exhaust gas discharged from the combustion chambers of the internal combustion engine as a recirculation exhaust gas (recirculation gas) to the intake passage has an inflow passage, a recirculation control valve 32 and an outflow passage. The inflow passage and the outflow passage constitute an exhaust gas recirculation passage. The intake passage of the internal combustion engine has intake ports, an intake manifold and an intake pipe connected to the intake manifold, which are not shown.

The recirculation control valve 32 has a valve case 32*a* provided with a flange 32*b*. The flange 32*b* of the valve case 32*a* is fastened to a part of the side surface of the cylinder head, near the fourth branch pipe $\mathbf{3}_4$ of the exhaust manifold 1. The recirculation control valve 32 is provided with a valve element driven for movement by a dc motor or a stepping motor.

A recirculation pipe 33 connects the exhaust passage of the internal combustion engine to the recirculation control valve 32. The upper end 33*a*, with respect to the flowing direction of the recirculation exhaust gas, of the recirculation pipe 33, forming a recirculation exhaust gas inlet 34 is connected to the collecting pipe 4 at a position below, with respect to the flowing direction of the exhaust gas, the gas analyzer mounting hole 27 in which the exhaust gas analyzer 28 is fitted so as to open into the first intermediate collecting passage $\mathbf{26}_1$. The lower end 33*b*, with respect to the flowing direction of the recirculation exhaust gas, of the recirculation pipe 33 is connected to an inlet port, not shown, formed in the valve case 32*a* of the recirculation control valve 32. The axial distance and the angular distance on the collecting pipe 4 between the gas analyzer mounting hole 27 and the recirculation exhaust gas inlet 34 are determined selectively.

The recirculation exhaust gas inlet 34 opening into the first intermediate collecting passage $\mathbf{26}_1$ is on the upper side, with respect to the flowing direction of the exhaust gas, of the exhaust pipe 30 forming the lower collecting passage 31 forming a part of the exhaust passage; that is, the recirculation exhaust gas inlet 34 is nearer to the cylinder head of the engine body of the internal combustion engine than the exhaust pipe 30. Thus, the recirculation pipe 33 forming the recirculation passage and connecting the recirculation exhaust gas inlet 34 to the recirculation control valve 32 attached to the cylinder head may be relatively short, the heat dissipation of the recirculation exhaust gas flowing through the recirculation pipe 33 is suppressed, and the recirculation exhaust gas flowing through the recirculation pipe 33 can be maintained at a comparatively high temperature. The recirculation exhaust gas of a high temperature promotes the oxidation of carbon and hydrocarbons contained in the recirculation exhaust gas and hence the deposition of deposits including carbon on the valve element of the recirculation control valve 32 and in the passage of the recirculation control valve 32 can be suppressed.

The flange 32*b* of the recirculation control valve 32 is provided with an output port 32*c*. The recirculation exhaust gas is delivered through the outlet port 32*c* at a controlled flow rate. The outlet port 32*c* is connected to the outflow passage essentially consisting of head passages, not shown, formed in the cylinder head, and a passage having an upper end connected to the head passages and a lower end connected to the intake passage.

The opening of the recirculation control valve 32 is controlled according to the operating condition of the internal combustion engine by a control signal provided by the controller to make the recirculation exhaust gas flow through the recirculation passage at a controlled flow rate into the intake passage. In an operating range for operation in a lean-burn mode, the recirculation exhaust gas is recirculated at a high flow rate to the intake passage.

Since the recirculation exhaust gas inlet 34 is on the lower side of the exhaust gas analyzer 28 and part of the exhaust gas is extracted as the recirculation exhaust gas at a position below the exhaust gas analyzer 28, it is possible to prevent difference between the ratio of effect of the cylinders on a measured value measured by the exhaust gas analyzer 28 due to recirculation exhaust gas extraction, particularly, due to recirculation exhaust gas extraction at a high rate. Consequently, accurate air-fuel ratio control can be achieved on the basis of the data provided by the exhaust gas analyzer 28, fuel consumption can be improved by lean-burn operation, and the $NO_x$ concentration of the exhaust gas can be reduced and fuel consumption can be improved by the recirculation of the exhaust gas.

Since the interior of a collecting pipe 4 is divided into the first intermediate collecting passage $\mathbf{26}_1$ and the second intermediate collecting passage $\mathbf{26}_2$ by the partition plate 25, and the intermediate collecting passages $\mathbf{26}_1$ and $\mathbf{26}_2$ are connected the first and the second cylinder group, respectively, intake and exhaust efficiencies are improved and the output of the internal combustion engine can be enhanced. Since the measuring head 28*a* of the exhaust gas analyzer 28 is placed in the recess 25*a* of the partition plate 25 so as to straddle both the intermediate collecting passages $\mathbf{26}_1$ and $\mathbf{26}_2$, the exhaust gas analyzer placed in the recess 25*a* of the partition plate 25 dividing the exhaust passage into the intermediate collecting passages $\mathbf{26}_1$ and $\mathbf{26}_2$ is able to provide data not significantly affected by difference between the ratios of effect of the cylinders on a measured value measured by the exhaust gas analyzer 28, and the exhaust gas recirculation system having the exhaust gas analyzer 28 disposed in the recess 25*a* of the partition plate 25 can be formed in compact construction. Since the measuring head 28*a* of the exhaust gas analyzer 28 is placed in the recess 25*a* of the partition plate 25 and a part of the exhaust gas analyzer 28 lies in the partition plate 25, the exhaust gas analyzer 28 is partly screened from the high-temperature exhaust gas by the partition plate 25, which extends the life of the exhaust gas analyzer 28.

Since the recirculation exhaust gas inlet 34 opens into the first intermediate collecting passage $\mathbf{2}_1$, the recirculation exhaust gas inlet 34 is relatively near to the cylinder head. Thus, the recirculation pipe 33 forming the recirculation passage and connecting the recirculation exhaust gas inlet 34 to the recirculation control valve 32 attached to the cylinder head may be relatively short, the heat dissipation of the recirculation exhaust gas flowing through the recirculation pipe 33 is suppressed, and the recirculation exhaust gas flowing through the recirculation pipe 33 can be maintained at a comparatively high temperature. The recirculation exhaust gas of a high temperature promotes the oxidation of carbon and hydrocarbons contained in the recirculation exhaust gas and hence the deposition of deposits including carbon on the valve element of the recirculation control valve 32 and in the passage of the recirculation control valve 32 can be suppressed, and the recirculation control valve can be prevented from becoming incapable of flow control due to clogging with deposits.

An exhaust gas recirculation system in a seventh embodiment according to the present invention will be described, in which parts like or corresponding to those of the exhaust gas recirculating system in the sixth embodiment are denoted by the same reference characters. The exhaust gas recirculation system in the seventh embodiment is basically the same as the exhaust gas recirculation system in the sixth embodiment in construction and differs from the latter only in the construction of a collecting pipe included in an exhaust manifold. A collecting pipe 4 included in the seventh embodiment is not provided with any member corresponding to the partition plate 25. Exhaust gases discharged from the first to the fourth cylinders flow through the first to the fourth branch pipe of the exhaust manifold into a single collecting passage defined by the collecting pipe 4.

An exhaust gas analyzer 28 is placed in the collecting passage forming a section of an exhaust passage, and a recirculation exhaust gas inlet 34 opens into the collecting passage at a position below the exhaust gas analyzer 28 with respect to the flowing direction of the exhaust gas. Thus the ratios of effect of the cylinders on a measured value measured by the exhaust gas analyzer 28 are scarcely different from each other. Since the recirculation exhaust gas inlet 34 is formed at a position below the exhaust gas analyzer 28 with respect to the flowing direction of the exhaust gas to extract part of the exhaust gas flowed past the exhaust gas analyzer 28 as the recirculation exhaust gas, it is possible to prevent the ratios of the amount of the exhaust gases discharged from the cylinders in the exhaust gas to be analyzed by the exhaust gas analyzer 28 from differing from each other due to recirculation exhaust gas extraction, particularly, due to recirculation exhaust gas extraction at a high rate, and hence the ratios of effect of the cylinders on a measured value measured by the exhaust gas analyzer 28 are prevented from differing from each other.

The recirculation exhaust gas inlet 34 opening into the collecting passage is on the upper side, with respect to the flowing direction of the exhaust gas, of the exhaust pipe 30 forming a part of the exhaust passage; that is, the recirculation exhaust gas inlet $\mathbf{3}_4$ is nearer to the cylinder head of the engine body of the internal combustion engine than the exhaust pipe 30. Thus, the recirculation pipe 33 may be relatively short, the heat dissipation of the recirculation exhaust gas flowing through the recirculation pipe 33 is suppressed, and the recirculation exhaust gas flowing through the recirculation pipe 33 can be maintained at a comparatively high temperature. The recirculation exhaust gas of a high temperature promotes the oxidation of carbon and hydrocarbons contained in the recirculation exhaust gas and hence the deposition of deposits including carbon on the valve element of the recirculation control valve 32 and in the passage of the recirculation control valve 32 can be suppressed.

The seventh embodiment exercises the same effect as that exercised by the sixth embodiment excluding the effect of the partition plate 25.

In the seventh embodiment, the recirculation exhaust gas inlet 34 may open into the second intermediate collecting passage $\mathbf{26}_2$ instead of into the first intermediate collecting passage $\mathbf{26}_1$. In the sixth and the seventh embodiment, the recirculation exhaust gas inlet 34 may be formed in a part of the exhaust passage below the collecting pipe 4 of the exhaust manifold 1, such as a part of the exhaust pipe 30 instead of in the collecting pipe 4. In the sixth and the seventh embodiment, the multicylinder internal combustion engine may be of a compression-ignition system.

What is claimed is:

1. An exhaust gas recirculation system comprising:

a recirculation passage having one end connected to an exhaust passage included in an internal combustion engine and the other end connected to an intake passage included in the internal combustion engine to extract part of an exhaust gas from the exhaust passage and to recirculate the same to the intake passage;

a recirculation control valve placed in the recirculation passage to control flow of the recirculation exhaust gas into the intake passage;

a recirculation pipe forming a part of the recirculation passage having a section extending close to and along an exhaust pipe forming a part of the exhaust passage; and a heat insulating cover covering both the recirculation pipe of the recirculation passage and the exhaust pipe of the exhaust passage.

2. An exhaust gas recirculation system comprising:

a recirculation passage having one end connected to an exhaust passage included in an internal combustion engine and the other end connected to an intake passage included in the internal combustion engine to extract part of an exhaust gas from the exhaust passage and to recirculate the same to the intake passage;

a recirculation control valve placed in the recirculation passage to control flow of the recirculation exhaust gas into the intake passage, said exhaust passage includes, branch pipes for conducting the exhaust gas from the internal combustion engine, a collecting pipe commonly connected to the branch pipes for collecting the exhaust gas from the branch pipes, and a recirculation pipe forming a part of said recirculation passage and being connected to said collecting pipe and having a section extending close to and along one of said branch pipes in a heat transfer relationship; and a heat insulating cover covering the recirculation pipe, branch pipes and collecting pipe.

3. The exhaust gas recirculation system according to claim 2, wherein the exhaust gas flowing in the recirculation pipe has a flow direction which is opposite to a flow direction of the exhaust gas in said one of the branch pipes.

4. An exhaust gas recirculation system comprising:

a recirculation passage having one end connected to an exhaust passage included in an internal combustion engine and the other end connected to an intake passage included in the internal combustion engine to extract part of an exhaust gas from the exhaust passage and to recirculate the same to the intake passage;

a recirculation control valve placed in the recirculation passage to control flow of the recirculation exhaust gas into the intake passage, said exhaust passage includes, branch pipes for conducting the exhaust gas from the internal combustion engine, a collecting pipe commonly connected to the branch pipes for collecting the exhaust gas from the branch pipes, and a recirculation pipe forming a part of said recirculation passage and being connected to said collecting pipe and having a section extending close to and along one of said branch pipes in a heat transfer relationship; and the branch pipes and recirculation pipe are joined by a common flange at one end.

* * * * *